US006821696B2

(12) United States Patent
Katagiri et al.

(10) Patent No.: US 6,821,696 B2
(45) Date of Patent: Nov. 23, 2004

(54) TONER FOR OPTICAL FIXING, MANUFACTURING METHOD THEREFOR AND IMAGE FORMATION APPARATUS USING IT

(75) Inventors: Yoshimichi Katagiri, Kawasaki (JP); Yasushige Nakamura, Kawasaki (JP); Shinichi Yaoi, Kawasaki (JP); Tomoaki Tanaka, Kawasaki (JP); Seijiro Ishimaru, Kawasaki (JP); Satoshi Takezawa, Kawasaki (JP); Katsuji Ebisu, Kawasaki (JP); Makoto Fukuda, Kawasaki (JP); Hiroyuki Sasaki, Yao (JP); Yojiro Kumagae, Yao (JP)

(73) Assignee: Fuji Xerox Co., Ltd., Tokyo (JP)

( * ) Notice: Subject to any disclaimer, the term of this patent is extended or adjusted under 35 U.S.C. 154(b) by 68 days.

(21) Appl. No.: 10/160,083

(22) Filed: Jun. 4, 2002

(65) Prior Publication Data

US 2002/0150830 A1 Oct. 17, 2002

Related U.S. Application Data

(63) Continuation-in-part of application No. 09/956,914, filed on Sep. 21, 2001, now abandoned.

(30) Foreign Application Priority Data

Mar. 30, 2001 (JP) ..... 2001-102603
Dec. 25, 2001 (JP) ..... 2001-392759

(51) Int. Cl.[7] ..... G03G 9/00
(52) U.S. Cl. ..... 430/108.21; 430/137.18
(58) Field of Search ..... 430/108.21, 137.18

(56) References Cited

U.S. PATENT DOCUMENTS

| | | | | |
|---|---|---|---|---|
| 4,539,284 A | * | 9/1985 | Barbetta et al. | 430/108.23 |
| 5,432,035 A | * | 7/1995 | Katagiri et al. | 430/108.2 |
| 6,136,488 A | * | 10/2000 | Kushino et al. | 430/108.21 |

FOREIGN PATENT DOCUMENTS

| | | |
|---|---|---|
| JP | 58-102247 | 6/1893 |
| JP | 60-57858 | 4/1985 |
| JP | 60-230667 | 11/1985 |
| JP | 7-191492 | 7/1995 |
| JP | 10-39535 | 2/1998 |
| JP | 11-65167 | 3/1999 |
| JP | 2000-147824 | 5/2000 |
| JP | 2000-214626 | 8/2000 |

* cited by examiner

*Primary Examiner*—Mark A. Chapman
(74) *Attorney, Agent, or Firm*—Westerman, Hattori, Daniels & Adrian, LLP

(57) ABSTRACT

It is a toner for optical fixing which contains a binder resin, a colorant, and an infrared light absorbent, and the infrared light absorbent has a coloring opacity of 20 or less, and of phthalocyanine compound and/or naphthalocyanine compound.

13 Claims, 5 Drawing Sheets

FIG.2

| No | 1 | 2 | 3 | 4 | 5 | 6 | 7 | 8 |
|---|---|---|---|---|---|---|---|---|
| SUBSTANCE | VANADYL NAPHTHALOCYANINE | | | | | | | |
| MANUFACTURE EXAMPLE | MANUFACTURE EXAMPLE 1 | | | | | | | |
| SUBSTITUENT (R1-R8) | R1 THROUGH R8 ARE ALL HYDROGEN | | | | | | | |
| SPECIFIC SURFACE AREA | 1.8 | 19.1 | 29.6 | 46.6 | 58.3 | 83.3 | 111.8 | 131.1 |
| MAXIMUM PARTICLE DIAMETER | 37 | 9 | 4 | 3.9 | 3.8 | 3.8 | 2.3 | 1.2 |
| VOLUME AVERAGE PARTICLE DIAMETER | 20.3 | 1.32 | 0.87 | 0.66 | 0.51 | 0.37 | 0.24 | 0.21 |
| OPACITY | 30 | 24 | 21 | 16 | 13 | 12 | 12 | 12 |
| PAS INTENSITY | 0.036 | 0.042 | 0.064 | 0.074 | 0.083 | 0.082 | 0.081 | 0.067 |
| MANUFACTURE COST | ◎ | ○ | ○ | ○ | ○ | ○ | △ | ×× |

| No | 9 | 10 | 11 | 12 | 13 | 14 | 15 |
|---|---|---|---|---|---|---|---|
| SUBSTANCE | VANADYL PHTHALO -CYANINE | ALMINIUM NAPATHALO -CYANINE | TINE NAPHTHALO -CYANINE | TITANYL NAPHTHALO -CYANINE | ALOKOXYALKYL-SUBSTITUTED NAPATHALOCYANINE | COMPOUND OF FAMILY OF PHTHALOCYANINE /NAPHTHALOCYANINE | ALOKOXYALKYL -SUBSTITUTED NAPHTHALO -CYANINE |
| MANUFACTURE EXAMPLE | MANUFACTURE EXAMPLE 1 | MANUFACTURE EXAMPLE 2 | MANUFACTURE EXAMPLE 3 | MANUFACTURE EXAMPLE 4 | MANUFACTURE EXAMPLE 5 | MANUFACTURE EXAMPLE 6 | MANUFACTURE EXAMPLE 7 |
| SUBSTITUENT (R1-R8) | R1-R8 ARE ALL HYDROGEN | | | | R1, R3, R5, R7 ARE $-OC_8H_{17}$, OTHERS ARE HYDROGEN | R1&R2, R3&R4, R5&R6, R7&R8 ARE $->C_4H_6$ OR $-OC_8H_{17}$ AND H | R1, R3, R5, R7 ARE $->OC_3H_7$, OTHERS ARE HYDROGEN |
| SPECIFIC SURFACE AREA | 153.2 | 60.3 | 55.4 | 60.7 | 63.2 | 50.2 | 53.2 |
| MAXIMUM PARTICLE DIAMETER | 1.2 | - | - | - | - | - | - |
| VOLUME AVERAGE PARTICLE DIAMETER | 0.2 | - | - | - | - | - | - |
| OPACITY | 12 | 10 | 10 | 20 | 14 | 14 | 14 |
| PAS INTENSITY | 0.065 | 0.092 | 0.09 | 0.067 | 0.082 | 0.094 | 0.083 |
| MANUFACTURE COST | ××× | ○ | ○ | ○ | ○ | ○ | ○ |

FIG.3

| No | 1 | 2 | 3 | 4 | 5 | 6 | 7 | 8 |
|---|---|---|---|---|---|---|---|---|
| TONER NAME | A | B | C | D | E | F | G | H |
| TONER COLOR | YELLOW | YELLOW | YELLOW | YELLOW | YELLOW | YELLOW | YELLOW | YELLOW |
| TYPE OF INFRARED ABSORBENT | No. 1 | No. 2 | No. 3 | No. 4 | No. 5 | No. 6 | No. 7 | No. 8 |
| ADDITIVE AMOUNT | 0.75 | 0.75 | 0.75 | 0.75 | 0.75 | 0.75 | 0.75 | 0.75 |
| SPECIFIC SURFACE AREA | 1.8 | 19.1 | 29.6 | 46.6 | 58.3 | 83.3 | 111.6 | 131.1 |
| SURFACE EXISTENCE RATE | 6.1 TIMES | 4.3 TIMES | 2.4 TIMES | 1.9 TIMES | 1.6 TIMES | 1.6 TIMES | 1.4 TIMES | 1 TIME |
| FIXING PERFORMANCE | × | △ | △ | ◎ | ◎ | ◎ | ○ | △ |
| COLOR TONE | ×× | × | △ | △−○ | ○ | ○ | ○ | ○ |
| IMAGE CHARACTERISTIC | × | △ | ○ | ○ | ◎ | ◎ | ◎ | ◎ |
| TOTAL JUDGEMENT | × | × | △ | ○ | ○ | ○ | ○ | △ |

| No | 9 | 10 | 11 | 12 | 13 | 14 | 15 | 16 |
|---|---|---|---|---|---|---|---|---|
| TONER NAME | I | J | K | L | M | N | O | P |
| TONER COLOR | YELLOW | YELLOW | YELLOW | YELLOW | YELLOW | YELLOW | YELLOW | YELLOW |
| TYPE OF INFRARED ABSORBENT | No. 9 | No. 10 | No. 11 | No. 12 | No. 13 | No. 14 | No. 4 | No. 4 |
| ADDITIVE AMOUNT | 0.75 | 0.75 | 0.75 | 0.75 | 0.75 | 0.5 | 0.05 | 0.3 |
| SPECIFIC SURFACE AREA | 153.2 | 60.3 | 55.4 | 60.7 | 63.2 | 50.2 | 46.6 | 46.6 |
| SURFACE EXISTENCE RATE | 1 TIME | — | — | — | — | — | — | — |
| FIXING PERFORMANCE | × | ◎ | ◎ | ○ | ○ | ◎ | ×× | △−○ |
| COLOR TONE | ◎ | ◎ | ◎ | × | ○ | ○ | ◎ | ◎ |
| IMAGE CHARACTERISTIC | ○ | ◎ | ◎ | ○ | ○ | ○ | ○ | ○ |
| TOTAL JUDGEMENT | × | ○ | ○ | × | ○ | ○ | × | ○ |

| No | 17 | 18 | 19 | 20 | 21 |
|---|---|---|---|---|---|
| TONER NAME | Q | R | S | T | M |
| TONER COLOR | YELLOW | YELLOW | YELLOW | RED | RED |
| TYPE OF INFRARED ABSORBENT | No. 4 | No. 4 | No. 4 | No. 4 | No. 15 |
| ADDITIVE AMOUNT | 0.5 | 3 | 6 | 0.75 | 0.5 |
| SPECIFIC SURFACE AREA | 46.6 | 46.6 | 46.6 | 46.6 | 53.2 |
| SURFACE EXISTENCE RATE | — | — | — | — | — |
| FIXING PERFORMANCE | ○ | ◎ | ◎ | ◎ | ○ |
| COLOR TONE | ○ | △−○ | ×× | ◎ | ◎ |
| IMAGE CHARACTERISTIC | ○ | ○ | ×× | ◎ | ○ |
| TOTAL JUDGEMENT | ○ | ○ | × | ○ | ○ |

TONER FOR OPTICAL FIXING, MANUFACTURING METHOD THEREFOR AND IMAGE FORMATION APPARATUS USING IT

This application is a Continuation-In-Part of Ser. No. 09/956,914 filed Sep. 21, 2001, now abandoned.

BACKGROUND OF THE INVENTION

1. Field of the Invention

The present invention relates to a toner used in a copier or a printer performing image formation by a form of electrophotography or ionography, and to an image formation apparatus employing the toner. In particular, the present invention relates to a color toner for optical fixing containing a novel infrared light absorbent which absorbs optical energy and converts it into heat, and is fixed onto a recording medium such as a recording paper through optical irradiation thereof, and an image formation apparatus employing this toner.

Moreover, in other words, the present invention relates to a toner by which possible disorder of the color tone of the toner occurring as a result of the toner containing an infrared light absorbent as a component thereof is controlled, and a bright color tone also can be obtained even for a hue which is easy to be influenced of muddiness, such as lemon yellow, and an image formation apparatus employing this toner.

2. Description of the Related Art

As an image formation apparatus which performs printing of documents, copying, etc. in an office etc., one which employs electrophotography or ionography as a drawing principle is used regularly.

In an electrophotographic system, a uniform electrostatic charge is given on a photoconductive insulator (photosensitive drum, etc.), and an electrostatic latent image is formed by applying an optical image on the photoconductive insulator by any of various methods. Subsequently, development of this electrostatic latent image is carried out so as to visualize it using fine powders called toner, then, after transferring the thus-obtained toner powder image onto a recording medium, such as a paper, it is fixed thereonto, and, thus, a printed image is obtained.

On the other hand, in an ionographic system, ion (charged particle) is generated by an ion generating unit, using a carrying drum which has an electrostatic coating as a dielectric member for carrying electrostatic charge, by using the ion, an electrostatic charge image is formed on the surface of the dielectric member. Then, the thus-formed electrostatic charge image is developed by a toner, and a printed image is obtained through processes of transferring and fixing like those of the above-mentioned electrophotographic system.

For the above-mentioned two image forming systems, the fixing process is approximately the same therebetween. A toner powder image formed on the recording medium is fused by pressurization, heating, solvent steam, light, etc., and thus, adheres/is fixed onto the recording medium.

Recently, for the fixing process, an optical fixing form by which a powerful light is applied at a toner powder image and fuses the toner attracts attention by the following reasons:

(1) Since this is non-contacting fixing, blurring of an image, dust, etc. do not occur in the fixing process, and the resolution is not degraded.
(2) There is no waiting time after turning on of a power supply in the apparatus, and, thus, a quick start is possible.
(3) Since an exothermic unit, such as a heating roller, is not used, even if a recording paper is blocked in the fixing assembly by the system failure, there is no problem of ignition.
(4) Even for paper with paste, pre-printed paper, paper having different thickness, and so forth, it is possible to perform the fixing process regardless of such quality of the material and thickness of recording medium.

Currently, for this optical fixing system, the most general method is a flash fixing method which uses a xenon flash lamp for the light source therefor.

Process in which a toner is fixed to a recording paper in the above-mentioned flash fixing method will now be described. A toner (powder) image is transferred from a photosensitive drum etc. onto a recording medium (simply referred to as a recording paper, hereinafter). At this time, as the toner merely adheres to the recording paper in a form of a powder image, when it is rubbed by a finger, for example, the image is easily destroyed.

When flash light (glint of light), such as a xenon flash, is applied to this toner powder image, the toner absorbs the optical energy of the glint of light, this increases in temperature and softens, and thereby, sticks to the recording paper. Then, when the temperature is lowered after the glint-of-light application, the toner image solidifies, and, thus, a fixed image is obtained. It is important to prevent so-called poor fixing performance which causes degradation of quality of the image as a result of the once fixed image being exfoliating from the recording paper when it is bent, or rubbed.

In order to prevent such a situation, the toner used in the optical fixing should satisfy at least the following conditions simultaneously:

(1) The capability of the toner is improved so that the toner absorbs a sufficient quantity of heat.
(2) The toner should fuse promptly by absorbing heat, and permeates a recording paper.
(3) After being cooled, the toner should adhere to the recording paper firmly.

Moreover, as shown in FIG. 1, a xenon flash lamp generally used by the optical fixing method has a luminescence distribution through a wider range from ultraviolet to infrared wavelength zones. Especially, this has a strong luminescence intensity, in a near-infrared zone of 800 through 1050 nm. In order to achieve a toner having superior fixing performance, establishment of technology, i.e., technology of using optical energy of this near-infrared zone efficiently, that is, effectively reduction of necessary optical energy to be used, is also needed.

A demand for color printing is increasing especially in recent years. Although a colorant used for a color toner absorbs light in part of a visible light wavelength zone, the light absorbing efficiency for a near-infrared wavelength zone is low. That is, the colorant used for a color toner has a characteristic of being hardly absorbing thermal energy from applied light, and, thus, the toner needs a large energy to be applied for fusion thereof.

Therefore, to put into practice a color toner by which satisfactory fixing performance/characteristic is obtained while the necessary energy can be reduced in the optical fixing system is demanded.

Moreover, with regard to a black toner, while a black color agent which is a colorant absorbs all light of the visible light zone, it also absorbs light of the near-infrared zone relatively well. Therefore, it has been already put in practical use in an electronic photography apparatus which employs the optical fixing system. However, in order to cope with an increasing demand for saving energy in recent years, reduction of the necessary optical energy to be applied is demanded. Thereby, further improvement of light absorbing efficiency of the black toner is demanded.

For the above-mentioned demand, various proposals have been given by Japanese Laid-Open Patent Applications Nos. 58-102247, 60-57858, 7-191492, 10-39535 and 11-65167, Japanese Patent Publication No. 7-23965, Japanese Patent No. 3011936, Japanese Laid-Open Patent Applications Nos. 2000-147824, 2000-214626, etc. By these proposals, technology which heightens flash light absorbing capability as a result of a toner containing as an infrared light absorbent, an amide compound which has a light absorbing capability for a near-infrared zone such as for example, aminium salts, a thiol nickel family complex, an indium oxide family metal oxide, a tin oxide family metal oxide, a zinc oxide family metal oxide, tin acid cadmium, a phthalocyanine and/or naphthalocyanine family compound, a merocyanine pigment, a polymethine pigment, a specific amide compound, etc.

Among the above-mentioned compounds, aminium salts, thiol nickel family complex, phthalocyanine and/or naphthalocyanine family compound and so forth are relatively excellent in performance balance as an infrared light absorbent to be added to a toner for the optical fixing process.

However, aminium salts have the problems as mentioned in the following items (1) and (3), and, also, the thiol nickel family complex and phthalocyanine and/or naphthalocyanine family compound have the problems as mentioned in the following items (2) and (3):

(1) The electrification of the toner may be problematically influenced thereby.

(2) When the toner has a color other than monochrome color, the color tone of the compound used as the infrared light absorbent therein may affect the hue of the toner.

(3) The unit price of the compound may cause the cost rise of the toner highly.

SUMMARY OF THE INVENTION

Therefore, an object the present invention is to provide a flash fixing toner at low cost by which influence on electrification performance and a hue change based on infrared light absorbent addition can be effectively reduced, and to provide a color image formation apparatus employing the toner.

In particular, an object of the present invention is to provide a toner by which muddiness of color tone resulting from adding the infrared light absorbent is suppressed, and which provides a bright color tone also for a hue such as lemon yellow which tends to produce muddiness, and to provide an image formation apparatus employing the toner.

A toner according to the present invention for optical fixing, includes, at least:

a binder resin;

a colorant; and an infrared light absorbent, wherein:

a coloring opacity of the infrared light absorbent is 20 or less; and the infrared light absorbent has a structure expressed by the following chemical formula (1) and/or (2);

Chemical Formula (1)

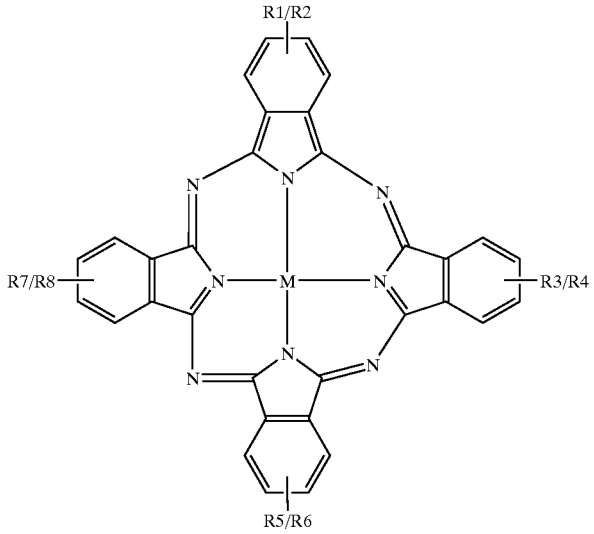

-continued

Chemical Formula (2)

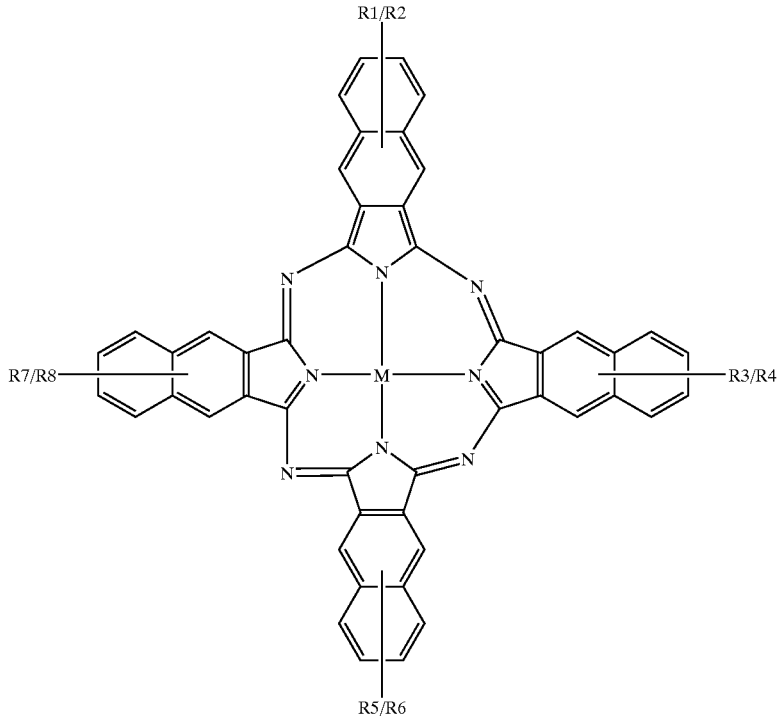

wherein:

each of R1 through R8 denotes a substituent added to a benzene ring or a naphthalene ring, and comprises a hydrogen, a halogen atom, a saturated or unsaturated hydrocarbon group having the number of carbons in a range between 1 and 18, or an oxygen and/or nitrogen content hydrocarbon group having the number of carbons in a range between 1 and 13; and M denotes two hydrogen atoms, a divalent metal, or a trivalent or tetravalent metal derivative.

Thereby, since the infrared light absorbent with a low coloring opacity is thus used, even when the color of toner is of a light hue, such as yellow, it is possible to form a bright/clear image without muddiness in color.

The infrared light absorbent may have a specific surface area in a range between 40.0 and 120.0 $m^2/g$ measured by a BET method.

Thereby, the infrared light absorbent in the state where it is added into the toner provides a function to transform the irradiated optical energy into thermal energy effectively.

The inventors and so forth confirmed that, in order to achieve the function in which the infrared light absorbent in the state where it is added to the toner transforms the irradiated optical energy into thermal energy effectively, in measurement of the phthalocyanine compound expressed by the above-mentioned chemical formula (1) and/or the naphthalocyanine compound expressed by the above-mentioned chemical formula (2) by the BET method, the specific surface area thereof should be not less than 40.0 $m^2/g$, more preferably, in a range between 40.0 and 120.0 $m^2/g$.

FIG. 2 shows a result of measurement of the specific surface area of the infrared light absorbent added to the toner and the calorific value measured when light was applied to the toner by using a photo-acoustic spectroscopic analysis (PAS: Photo-acoustic Spectroscopy). According to this analysis result, as the specific surface area of the infrared light absorbent increases, the light absorbing calorific value per the amount of addition of the above-mentioned phthalocyanine and/or naphthalocyanine compound increases.

The inventors etc. confirmed that the increase of the specific surface area (to produce finer particles) of the infrared light absorbent is far effective rather than increase of the amount of addition of the above-mentioned compound and so forth from a viewpoint of the light-to-heat conversion effect. The inventors and so forth inferred that the above-mentioned effect can be obtained not only because the light-receiving area thereof increases when the above-mentioned phthalocyanine and/or naphthalocyanine compound has finer particles, but also because the contact surface with the dispersion medium such as the binder resin increases thereby, and, as a result, heat conduction between the infrared light absorbent and the dispersion medium can be performed smoothly.

By the way, according to research by the inventors and so forth, in case where the toner is manufactured by a grinding method, when the specific surface area is made more than 120.0 $m^2/g$, no improvement in light-to-heat conversion efficiency is found, but rather it tends to be degraded. Furthermore, grinding and making finer particles raises the manufacture cost. Therefore, to increase the specific surface area without limitation is not preferable.

The inventors etc. inferred, for the fact that there is a case where the light-to-heat conversion efficiency is degraded as the specific surface area is further increased as mentioned above, as follows:

FIG. 3 shows the rate of surface existence of the above-mentioned infrared light absorbent near the surface of particle of the toner (the depth of about 2 micrometers). This rate of surface existence is a value contrived as a result of ultimate analysis (SIMS) in which the central element M of the above-mentioned phthalocyanine and/or the naphthalocyanine compound used as the infrared light absorbent is regarded as the label substance.

As can be seen from the analysis result, the rate of surface existence of the above-mentioned compound near the surface of the toner particle is reduced as the specific surface area of this compound added internally into the toner increases. The maximum difference thereof reaches 6 times.

The optical energy applied to the toner particle only reaches the infrared light absorbent of the toner surface or the neighborhood thereof; and does not reach the infrared light absorbent in the central part of the particle. By this reason, the infrared light absorbent located in the center of the toner particle does not contribute to light-to-heat conversion efficiency very much. Therefore, the further increase of the specific surface area of the infrared light absorbent rather causes reduction in the surface existence rate of the compound near the toner particle surface although it results in slight increase in the light-to-heat conversion efficiency per unit weight. Thus, it is inferred that the saturation or reduction tendency of the light-to-heat conversion efficiency as total results from the influence of the above-mentioned reduction in the surface existence rate near the toner particle surface.

In addition, the mechanism in which the infrared light absorbent near the toner particle surface existence rate decreases as the particle of the infrared light absorbent is made finer can be inferred to relate to a fact that a toner lump tends to break at the interface between the toner internal additive and binder resin during a process of grinding to produce finer particles. That is, when the particle of internal additive material of the toner (the infrared light absorbent, etc.) is somewhat large, a big interface exists between binder resin and the additive in the toner. Since this part is weak to a shock, the toner lump breaks at the part. As a result, the toner internal additive material is easy to be exposed to the surface of the thus-generated toner particles. Accordingly, the toner particle surface existence rate of the toner internal additive material increases in comparison to that at the toner central part.

However, since the mechanical strength difference between part of only the binder resin and part having interface between the binder resin and the internal additive maternal in the toner becomes small in the toner lump when the particle size of the internal additive material in the toner becomes very smaller, the above-mentioned mechanism becomes not likely to occur in crush of the toner lump. And, the more the internal additive material has finer particles, the more the difference of the surface existence rate of the internal additive maternal particles between neighborhood of the toner particle surface and the inside thereof is reduced.

In addition, atomization of the infrared light absorbent reduces the coloring opacity of the above-mentioned phthalocyanine and/or the naphthalocyanine compound.

FIG. 2 also shows the specific surface area of the above-mentioned phthalocyanine and/or naphthalocyanine compound added to the toner and the coloring opacity of the toner which contains only this compound as the coloring component. From this analysis result, it can be seen that the coloring opacity per amount of addition of the compound falls as the particle size of the above-mentioned compound is made finer.

The definition and the measurement method of the coloring opacity will be described in detail later.

The central element M in the chemical formula (1) and/or (2) may comprise aluminum or tin.

When Al or Sn is thus used as the element M of the above-mentioned phthalocyanine and/or naphthalocyanine compound, it can become possible to reduce absorption of the visible light wavelength zone (to further lighten the color) while the main absorption wavelength zone is maintained in a range between 800 and 1000 nm. Thereby, it is possible to remarkably reduce the inference on the color tone of the toner in a case where the phthalocyanine and/or naphthalocyanine compound is added to the toner.

FIG. 4 shows change in absorbance of the visible light wavelength zone resulting from changing the central metal M of the above-mentioned phthalocyanine and/or naphthalocyanine compound.

Although the absorbing power in the infrared light wavelength zone is the order of vanadium≧aluminum≧tin>titanium, it turns out that it is titanium>vanadium>tin>aluminum in the visible light wavelength zone. The fact that the absorption in the visible light wavelength zone is small shows that the original color tone of the toner is prevented from being spoiled even for a toner of light color tones, such as lemon yellow.

The fact that the absorption for the visible light wavelength zone is thus smaller means that the above-mentioned coloring opacity of the infrared light absorbent is reduced. Therefore, it can be seen that the coloring opacity of the infrared light absorbent can be adjusted by appropriately selecting the specific surface area and/or the central element M of the phthalocyanine and/or the naphthalocyanine compound.

Any one or plurality of groups of R1 through R8 in the chemical formula (1) and/or (2) may be different from the other groups of R1 through R8.

Compared with the case where the above-mentioned phthalocyanine and/or naphthalocyanine compound has the same R1 through R8, when any one or plurality of groups of R1 through R8 differs, the light-to-heat conversion efficiency can be improved.

The inventors and so forth confirmed that the light-to-heat conversion efficiency tends to increase when the phthalocyanine and/or the naphthalocyanine compound which is formed so that any one or more groups of R1 through R8 may differ from the remaining ones of R1 through R8 in the above-mentioned chemical formula (1) or (2) is used as the infrared light absorbent.

This can be inferred to be because, when the skeleton structure thus differs, the absorption wavelength zone also shifts slightly, and the mixture thereof has a wider light absorption wavelength zone compared with one of a single compound, and thereby it can effectively transform a wider wavelength zone of applied light into heat.

As mentioned above, the infrared light absorbent contained in the toner of the present invention has a light color tone compared with an infrared light absorbent formed of other phthalocyanine and/or naphthalocyanine compound or other compounds, and has an outstanding characteristic that the coloring opacity is small. Therefore, the original color tone of the toner is prevented from being spoiled even for a light color tone, such as lemon yellow.

Furthermore, the toner according to the present invention is such that the amount of addition of the infrared light absorbent to the toner can be reduced necessarily because the reduced amount of addition of the infrared light absorbent can provide the sufficient fixing performance to the toner. This is because the infrared light absorbent having the large heat absorbance per unit weight is used. Also, it is costwisely advantageous, while mitigates the degree of influence thereby given to the toner color tone.

Further, the inventors of the present invention studied on a form of an infrared light absorbent in a toner in an actually usable state. Thereby, the inventors found out a form of a toner for optical fixing such that energy transformation efficiency from light to heat of the toner may improve, while no adverse influence be applied on the hue.

Specifically, according to the thus-obtained knowledge of the inventors, in order to obtain a toner for optical fixing further superior in fixing performance and also in vividness of fixed image, an infrared light absorbent included in a toner should preferably satisfy the following requirements:

A toner for optical fixing, comprises:

a binder resin;

a colorant; and an infrared light absorbent, wherein:

not less than 80% in cross-sectional area of particles of the infrared light absorbent in a dispersed state in the toner have Feret circle equivalent diameters falling within a range between 0.05 and 0.5 $\mu$m; and the infrared light absorbent has a structure expressed by the following chemical formula (1) and/or (2);

Chemical Formula (1)

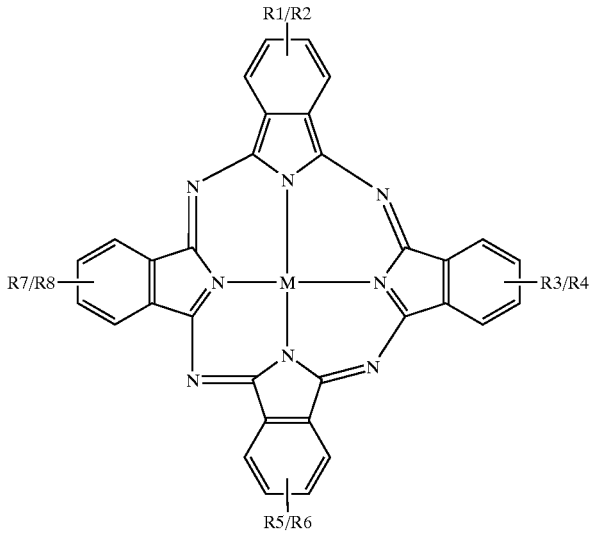

Chemical Formula (2)

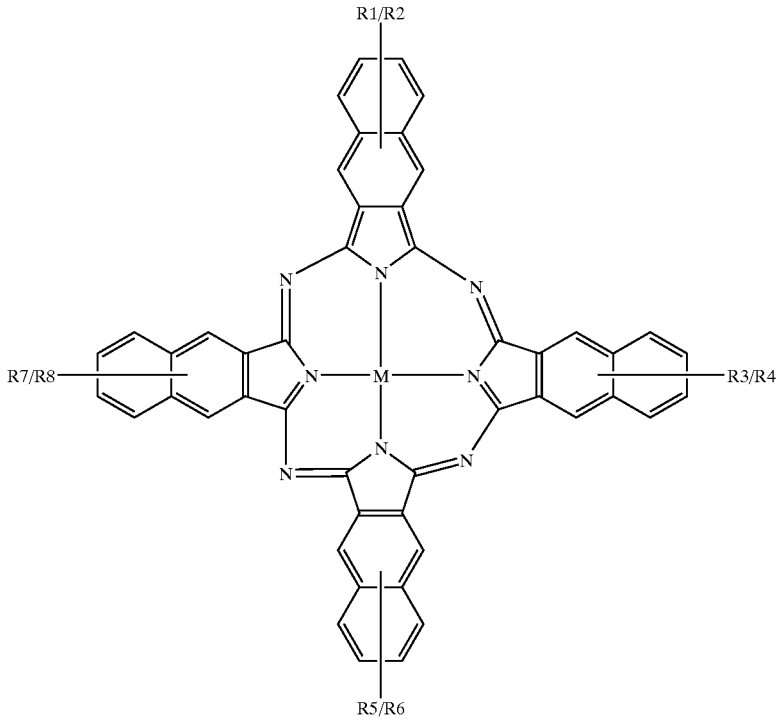

wherein:

each of R1 through R8 denotes a substituent added to a benzene ring or a naphthalene ring, and comprises a hydrogen, a halogen atom, a saturated or unsaturated hydrocarbon group having the number of carbons in a range between 1 and 18, or an oxygen and/or nitrogen content hydrocarbon group having the number of carbons in a range between 1 and 13; and M denotes two hydrogen atoms, a divalent metal, or a trivalent or tetravalent metal derivative.

Thus, the present invention described above has been devised directed to the state of the infrared light absorbent in the toner in a form of a product.

Especially, this form of the present invention exhibits superior performance by adding, in a finely dispersed manner, phthalocyanine and/or naphthalocyanine compounds or so having the above-mentioned chemical formulas (1) and/or (2) as the infrared light absorbent. Further, according to the study by the inventors of the present invention, it is important that more than 80% in cross-sectional area of the particles of the infrared light absorbent in the dispersed state in the toner have Feret circle equivalent diameters falling within the range between 0.05 and 0.5 $\mu$m, in order to cause the thus-produced toner to satisfactorily exhibit a superior function of transforming applied optical energy into heat energy.

Further, according to the study by the inventors, in case of manufacture of a toner through grinding, in order to achieve the above-mentioned requirements on the dispersed state of the infrared light absorbent in the toner that more than 80% in cross-sectional area of the particles of the infrared light absorbent in the dispersed state in the toner have the Feret circle equivalent diameters falling within the range between 0.05 and 0.5 $\mu$m, it is preferable that the infrared light absorbent be previously ground so fine that the specific surface area of the infrared light absorbent at a time of toner materiel mixing, measured according to the BET manner be not less than 40.0 $m^2/g$, more preferably, on the order of 40.0 through 120.0 $m^2/g$.

For example, in prior to mixing of respective materials of toner, the infrared light absorbent and toner constitutive materials such as binder resin and so forth are mixed for a long time interval by means of a batch-type kneader such as an open-type kneader or the like, so as to apply a considerable amount of kneading stress on the materials. Thereby, the infrared light absorbent are caused to be dispersed finely in the binder resin and so forth, and, thus, the thus-obtained matter may be used as a suitable raw material of the toner.

Further, the inventors of the present invention found out that it is possible to create a form of a toner having a higher light-to-heat transformation efficiency, as the concentration of the infrared light absorbent in the vicinity of the surface of the toner particle can be made higher.

For this purpose, according to the present invention, a method of manufacturing a toner for optical fixing, which toner comprises:

a binder resin;

a colorant; and an infrared light absorbent having a structure expressed by the above-mentioned chemical formula (1) and/or (2), comprises the steps of:

a) dispersing primarily the infrared light absorbent in a non-crosslinked polyester resin serving as a dispersion medium containing diol of not less than 80 mol % of constitutive alcohol; and b) melting, kneading and grinding the non-crosslinked polyester resin and infrared light absorbent having undergone the step a) with a toner raw material necessarily containing the binder resin, different from the non-crosslinked polyester resin, and the colorant, wherein the diol is expressed by the following chemical formula (3):

$$HO—[CR_2]_n—OH \qquad \text{Chemical Formula (3)}$$

where:

R denotes hydrogen, methyl group, or ethyl group; and n denotes a number in a range between 2 and 4, where R is not hydrogen when n=1.

Thereby, it is possible to manufacture a suitable toner for optical fixing.

Further, according to another aspect of the present invention, a method of manufacturing a toner for optical fixing, which toner comprises:

a binder resin;

a colorant; and an infrared light absorbent having a structure expressed by the above-mentioned chemical formula (1) and/or (2), comprises the steps of:

a) dispersing primarily the infrared light absorbent in a wax acting as a dispersion medium which is non-compatible with the binder resin used in the following step b); and b) melting, kneading and grinding the wax and infrared light absorbent having undergone the step a) with the wax and a toner raw material necessarily containing the binder resin; and the colorant.

Thereby, it is also possible to manufacture a suitable toner for optical fixing.

Further, in the above-described toner manufacture method, it is preferable that the binder resin comprises a polyester resin different from the non-crosslinked polyester resin and also different from the wax, which necessarily includes not less than trivalent acid, and/or not less than trivalent alcohol, and contains at least 1 wt % of insoluble matter for tetrahydroxyfuran.

Further, in the above-described toner manufacture method, it is preferable that the weight concentration of the infrared light absorbent dispersed in the non-crosslinked polyester and/or wax is less than thrice the weight concentration of the infrared light absorbent in the toner; and a setting is made such that the weight ratio between the non-crosslinked polyester and/or wax and the binder resin in the toner falls in a range between 35:65 and 70:30.

The inventors of the present invention prepared, by using a batch-type kneading machine or the like, non-crosslinked polyester resin containing diol shown by the above-mentioned chemical formula (3) of not less than 80 mol % of the constitutive alcohol and/or wax non-compatible with the binder resin as a dispersion medium. Then, a dispersion process was performed such that this dispersion medium and the infrared light absorbent were kneaded, and thus, the infrared light absorbent was finely dispersed in the dispersion medium. Then, the dispersion medium and infrared light absorbent having undergone the dispersion process were then kneaded with the binder resin, colorant and so forth, and, thus, the toner was obtained in a subsequent preparation process. It was then confirmed that, as the binder resin used there, a resin which necessarily contained not less than trivalent acid and/or not less than trivalent alcohol, and, also, contains not less than 1 wt % of insoluble for tetrahydroxyfuran was used, and, thereby, the light-absorbing-heat-generation amount increased.

In case where a resin is applied as the above-mentioned dispersion medium, the resin can also be regarded as a binder resin. However, the dispersion medium containing the infrared light absorbent in a dispersed state is further contained by another resin in a scattered state, and, thus, the toner is obtained. Accordingly, in order to avoid confusion, the resin used as the dispersion medium (also referred to as a dispersion resin) will not be referred to as a 'binder', while only the other resin which contains the dispersion resin in a scattered state is referred to as a binder resin.

The inventors of the present invention made following consideration as to a reason why the above-mentioned preferable phenomena can be obtained as a result of applying the dispersion medium and binder resin as described above.

(1) The non-crosslinked polyester resin containing diol expressed by the above-mentioned chemical formula (3) of not less than 80 mol % of the constitutive alcohol or a wax is relatively weak and thus has high brittleness against impact.

(2) The resin (binder resin) necessarily containing not less than trivalent acid and/or not less than trivalent alcohol and containing not less than 1 wt % of insoluble for tetrahydroxyfuran is relatively strong and thus has a low brittleness against impact.

(3) Accordingly, when impact is applied to a resin mass of a mixture of the both, there is high probability that the resin mass cleaves at a portion of the dispersion medium (above-mentioned non-crosslinked polyester resin or wax).

(4) Thereby, in case where a toner mass having a form of mixture of the binder resin and the dispersion medium (non-crosslinked polyester resin or wax) is ground, and thus, toner powder is produced, there is a high probability that the above-mentioned non-crosslinked polyester resin or wax is exposed on the surface of the thus-obtained toner powder.

As a result, it is possible to create a form such that the infrared light absorbent primarily dispersed in the dispersion medium (non-crosslinked polyester resin or wax) exists in the vicinity of the toner surface at a high concentration.

(5) In this form of toner, as the infrared light absorbent exists in the vicinity of the toner surface at a high concentration, a probability becomes higher that flash light applied reaches the infrared light absorbent before it is attenuated by the binder resin or the like, and thus, the light-to-heat transformation efficiency improves.

Instead of the above-mentioned non-crosslinked polyester resin, wax or so (dispersion medium) which should previously have the infrared light absorbent dispersed therein, a mixture or a combination of resins, waxes or so having desired properties may be used for the same purpose.

Furthermore, according to an experience of the inventors, it is not preferable to use a high concentration of the infrared light absorbent in the process of kneading and fine dispersion of the infrared light absorbent in the non-crosslinked polyester resin, wax or so. This is because, if the infrared light absorbent was dispersed at a high concentration in the resin, wax or the like used as the dispersion medium, the amount of the resin, wax or the like to be added to the toner would be relatively reduced. Thereby, the above-mentioned probability of cleavage of the resin mass at a portion of the non-crosslinked polyester resin, wax or so at a time of grinding the toner would be reduced, and, also, the infrared light absorbent would be very unevenly distributed in the toner remarkably.

Thus, the toner obtained by the above-described method according to the present invention uses an infrared light absorbent absorbing a large heat amount per unit weight, and, also, the infrared light absorbent is dispersed there at high concentration in the vicinity of the surface thereof. Accordingly, it is possible that the toner has a satisfactory fixing performance with a reduced amount of the infrared light absorbent added thereto. Accordingly, it is possible to control adverse influence of the infrared light absorbent on the hue of an image fixed therethrough, and also, to effectively reduce the costs as the used amount of infrared light absorbent is reduced.

An image forming apparatus according to the present invention performs image formation using the above-mentioned toner for visualizing of a latent image. Thereby, it is possible to obtain color image superior in color tone, fixing performance and image characteristics.

BRIEF DESCRIPTION OF THE DRAWINGS

Other objects and further features of the present invention will become more apparent from the following detailed description when read in conjunction with the accompanying drawings.

FIG. 2 show characteristics of various infrared light absorbents;

FIG. 3 show characteristics of various toners;

DETAILED DESCRIPTION OF THE PREFERRED EMBODIMENTS

Figure 1:
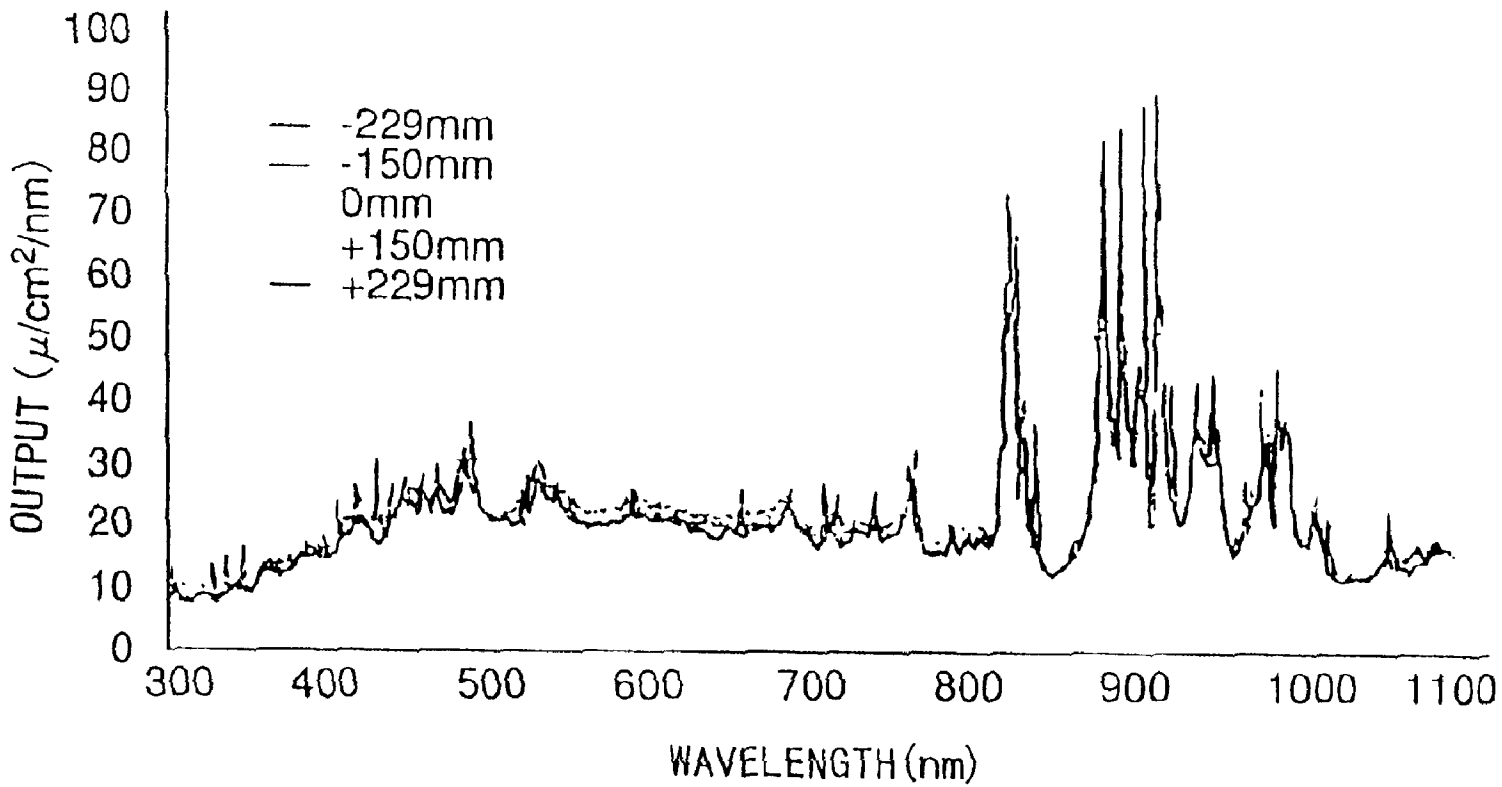
FIG. 1 shows luminescence distribution and luminescence intensity of a common xenon flash lamp.
Figure 4:
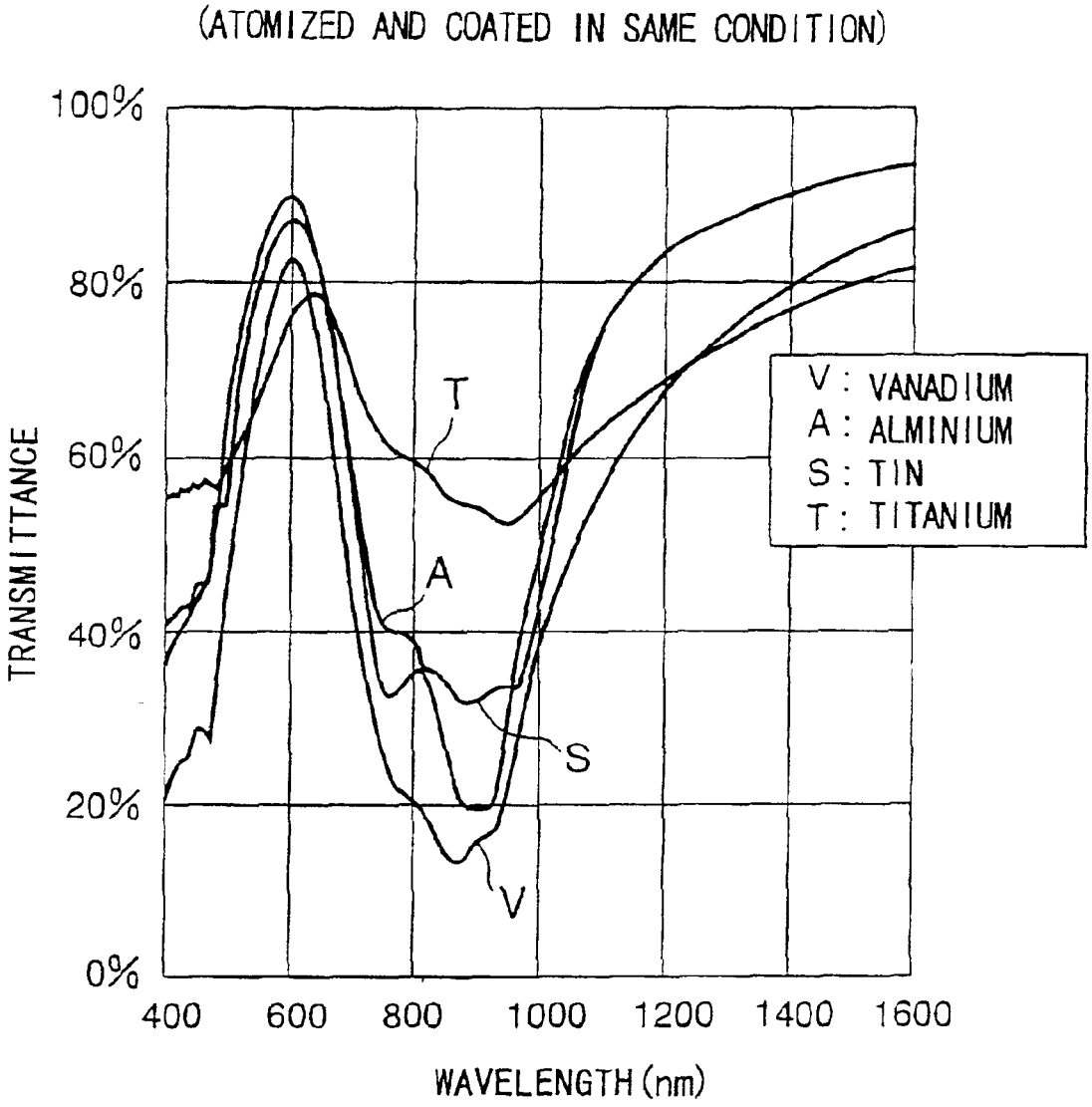
FIG. 4 shows change in absorbance of a visible light wavelength zone resulting from changing of a central metal M of phthalocyanine and/or naphthalocyanine compound.

Hereafter, with reference to figures, toner according to the present invention will be described in detail.

A toner according to the present invention contains a binder resin, a colorant, and an infrared light absorbent, at least. The toner according to the present invention has a feature in the infrared light absorbent. This infrared light absorbent has a structure expressed by the following chemical formula (1) and/or (2), and is phthalocyanine and/or naphthalocyanine compound having the following features:

Chemical Formula (1)

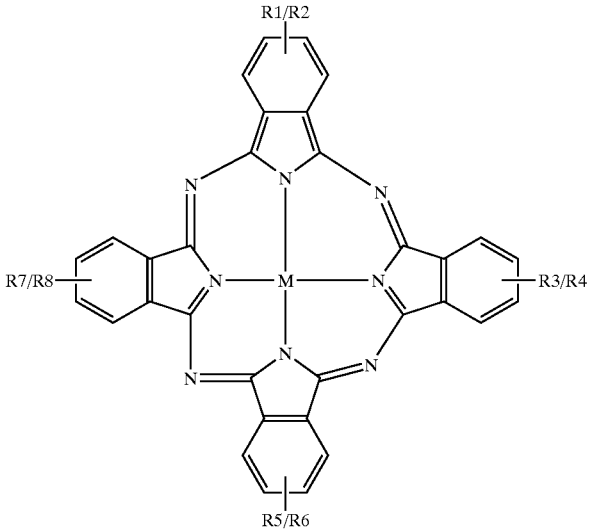

Chemical Formula (2)

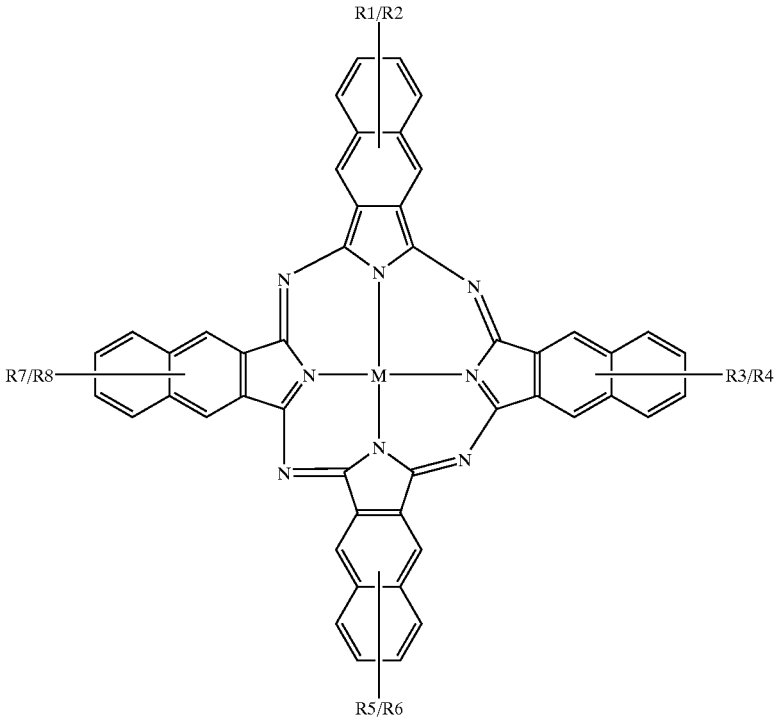

(1) First, it is set up so that the coloring opacity should be 20 or less.

(2) The specific surface area measured by a BET method is preferably within a range between 40.0 and 120.0 $m^2/g$.

(3) Preferably, the central element M is a metal, and is aluminum or tin.

(4) In the above-mentioned chemical formula (1) and/or (2), preferably, at least any one or more groups of R1 through R8 are different from the other groups of R1 through R8.

Then, in the toner according to the present invention, the above-mentioned infrared light absorbent is in a dispersed state, and, more than 80% in cross-sectional area of the particles have Feret circle equivalent diameters in the range between 0.05 and 0.5 $\mu$m. By containing the infrared light absorbent having this form, the toner can function to transform applied light energy into thermal energy sufficiently.

Hereafter, above-mentioned items (1) through (4) will be described.

According to the inventors of the present invention and so forth, the phthalocyanine and/or naphthalocyanine compound which is a compound expressed by the above-mentioned chemical formula (1) and/or chemical formula (2) has an absorption for a near-infrared zone of 800 nm through 1000 nm, and has a very strong absorption for light of 800 nm through 900 nm in the infrared light zone, especially. Hereafter, this phthalocyanine and/or naphthalocyanine compound will be abbreviated as a "phthalocyanine family compound".

A xenon flash lamp generally used as a light applying lamp of an optical fixing unit has a strong luminescence for near-infrared light zones of 800 nm through 850 nm and 900 nm through 1050 nm.

Therefore, a toner containing the above-mentioned phthalocyanine family compound absorbs the light of 800 through 900 nm for which the xenon flash lamp has the high luminescence energy intensity and converts it into heat, very efficiently.

Therefore, since the above-mentioned phthalocyanine family compound is added to the toner, light absorption for the near-infrared zone is improved remarkably. That is, as compared with the related art, a satisfactory fixing performance can be achieved even with energy given by a weaker flash light.

Although the phthalocyanine family compound thus has a superior light absorption performance, it has a color. Accordingly, the phthalocyanine family compound used in the present invention is set up so that the coloring opacity should be 20 or less, and thereby, a design is made such as to provide a toner by which a satisfactory color tone of a resulting printed image can be achieved. Specifically, the above-mentioned coloring opacity is set by appropriately adjusting the particle diameter of the phthalocyanine family compound, the surface area thereof, and, further, the central element M of the phthalocyanine family compound further.

It is preferable to make the specific surface area of the phthalocyanine family compound into the range between 40.0 and 120.0 $m^2/g$. Thereby, the infrared light absorption performance can be improved, while controlling the above-mentioned coloring opacity in a low level. These details will be described later.

Moreover, the inventors, etc. found out that a method of utilizing a steric hindrance effect of a substituent is useful such as to introduce an electron-donating group as the substituent R1 through R8 in the chemical formula (1) and/or chemical formula (2), in order to achieve bathochromic effect such as to move the absorption zone of the above-mentioned phthalocyanine family compound to a wavelength zone in which luminescence energy of a xenon flash light is strong.

Specifically, the phthalocyanine family compound with the strong absorption for 800 through 1000 nm can be obtained, which agrees for the object of the present invention, by specifically choosing a saturated or unsaturated hydrocarbon group having the number of carbons in a range between 1 and 18, or an oxygen and/or nitrogen content hydrocarbon group having the number of carbons in a range between 1 and 13, as the substituent thereof.

Below, the material to be included in the toner according to the present invention will be described.

Infrared Light Absorbent: Specific Phthalocyanine Family Compound

The toner according to the present invention contains the phthalocyanine family compound written by the above-mentioned chemical formula (1) and/or (2)

In addition, it is preferable that the coloring opacity (hiding power) of the above-mentioned phthalocyanine family compound is set to 20 or less, and, more preferable, to 15 or less. Thus, by thus setting such a low coloring opacity, even after it is added to the toner, a light color tone, such as yellow, is not problematically affected thereby.

Moreover, as described above, it is preferable that the specific surface area measured in accordance with the BET measuring method for the phthalocyanine family compound is equal to or more than 40.0 $m^2/g$, and, more preferably, 40.0 through 120.0 $m^2/g$.

In addition, a preferable amount of the phthalocyanine family compound used is 0.1 through 5.0 wt %. This is because the light energy absorbing performance of the toner for the near-infrared zone may be degraded and thus poor fixing performance may result, if the amount of addition is less than 0.2 wt %. On the other hand, increase in the material cost and/or undesired hue change may occur although the fixing performance becomes good, if the amount of addition exceeds 5.0 wt %.

It is possible to use together other well-known infrared light absorbent, for example, aminium salt, diimonium salt, metal oxide in a family of indium oxide, metal oxide in a family of tin oxide, metal oxide in a family of zinc oxide, cadmium stannate, merocyanine pigment, polymethine pigment, specific amide compound, lanthanoid compound, thiol nickel complex, etc., with the above-mentioned phthalocyanine family compound.

Binder Resin

As the binder resin, there is no specific limitation, and, a thermoplastic resin which consists of various natural or synthetic high polymer substance may be used. Typically, epoxy resin, styrene-acrylic resin, polyamide resin, polyester resin, polyvinyl resin, polyurethane resin, polybutadiene resin, etc. may be used solely or in any mixture thereof, having a weight-average molecular weight on the order of 5,000 through 100,000, and a melting point on the order of 90 through 140° C. by a flow-tester method.

The following method may be preferably applied: That is, a toner binder system is made of a mixture of a dispersion resin (dispersion medium) having the infrared light absorbent dispersed therein by means of a batch-type kneader or the like, and a binder resin not having the same dispersed therein. There, the respective materials are preferably selected such that the impact brittleness of the dispersion resin dispersing the infrared light absorbent be higher than that of the binder resin not dispersing the infrared light absorbent.

The inventors found out that, an acid such as isophthalic acid, telephthalic acid, aliphatic divalent acid and so forth, and a non-crosslinked polyester resin containing a relatively short chain aliphatic diol as a main diol ingredient, shown in the following chemical formula (3), represented by 1, 2 propylene glycol, 1, 3 propylene glycol, 1, 4 butadiene glycol, neopentyl glycol, and so forth, have high impact brittleness, and, thus, may be preferably applied as the above-mentioned dispersion resin.

$$HO—[CR_2]—OH \qquad \text{Chemical Formula (3)}$$

Further, a resin having a not-less-than-trivalent acid and/or a not-less-than-trivalent alcohol as an essential ingredient, and also, containing not less than 1 wt % of insoluble for tetrahydroxyfuran has relatively low impact brittleness, and, thus, may be preferably applied to the above-mentioned binder resin.

By employing a mixture resin system made of the above-mentioned combination, it is possible to obtain a form in which the infrared light absorbent dispersed in the resin having the higher brittleness is contained in the resin (binder resin) having lower brittleness. Accordingly, it is possible to produce the toner in which the infrared light absorbent is disposed at relatively high concentration in the vicinity of the toner particle surface.

Colorant

Especially a color agent (colorant) may not be limited, and, any of dye, pigments and so forth may be used. For example, in a color toner, quinacridone (red), phthalocyanine (blue etc.), anthraquinone (red), disazo (red or yellow), monoazo (red), compound in a family of anilide (yellow), benzidine (yellow), benzimidazolon (yellow), phthalocyanine halide (green), etc. may be used. In a black toner, black dye/pigments, such as carbon black, nigrosine dye, ferrite, or magnetite, may be used widely.

Electrification Control Agent

There is no specific limitation for an electrification control agent for controlling the electrification performance of the toner as long as it has a capability to give electrification to the toner. However, for the color toner, in order to avoid problematic influence on the hue of the toner, colorless or light-colored material is preferable. Preferably, as a positive electrification control agent, 4th class ammonium salt (colorless), nigrosine dye (black), and triphenylmethane derivative (blue), etc. may be used. As a negative electrification control agent, naphthoic acid zinc complex (colorless), zinc salicylate complex (colorless), a boron compound, Calixarene compound, etc. may be used.

WAX Composite

Wax etc. may be added to the toner for the purpose of such as to further improve the fixing performance of the toner. As the composite of the wax, a polyolefin or the like, such as polyethylene, polypropylene, or the like, fatty acid ester or the like, paraffin wax, carnauba wax, wax in a family of amide, acid-denatured polyethylene, etc. may be used solely or in any mixture thereof widely. Among these, one having a softening temperature of 150° C. or less is preferable, and, especially, it is preferable to employ one having a softening temperature lower than the fusion softening temperature of the toner binder.

A wax may also be applied to the above-mentioned dispersion medium. As the wax used as the dispersion medium previously dispersing the infrared light absorbent therein, it is preferable to apply one having low compatibility (non-compatible) with the binder resin. For example, one of paraffin wax, microcrystalline wax, carnauba wax, canderilla wax, rice wax, montan wax, polyethylene wax, polypropylene wax, fisher-tropush wax, amide wax, and so forth may be selected for this purpose.

External Additive

A material usually used may be used as an additive for externally adding to the toner. Inorganic fine particles, such as silica, titania, alumina, zinc oxide, or the like, or resin particles such as polystyrene, PMMA, melamine resin, or the like may be used.

Measurement methods for various physical properties used as indexes for representing special features of the color toner according to the present invention will now be described.

Definition and Measuring Method for Coloring Opacity

For example, 5 g of pigment (infrared light absorbent) is mixed into 95 g of vinyl chloride vinyl acetate copolymer solution of a composition shown below, and, then, it is dispersed for one hour by a paint shaker, the thus-obtained pigment dispersed liquid is uniformly coated on a polyester film having a thickness of 100 micrometers by using a bar coater so as to produce a film of the liquid thereon having a thickness of 20 micrometers after being dried.

The composition of the above-mentioned vinyl chloride vinyl acetate copolymer solution is as follows:

(1) Vinyl chloride vinyl acetate copolymer: 12 g;

(2) Ethylacetate: 19 g;

(3) MIBK: 25 g; and (4) MEK: 39 g

The dried sample in which the pigment dispersed liquid is coated on the film is evaluated based on an opacity examination paper method according to JIS K5101. A blank (white) paper (having a reflectance of 80±1) and a black paper (having a reflectance of 2 or less) according to JIS K5101 are used, the above-mentioned sample is stuck to each paper. Then, the brightness of each is measured by a spectophotometric colorimetry meter (CM-3700d, made by Minolta Camera Co., Ltd.) from the side of the sample. Thus, the coloring opacity is obtained. Here, the evaluation is made by using the following expression.

$$\text{Coloring opacity } (\%) = (LB/LW) \times 100$$

where:

LB: brightness on the black paper; and

LW: brightness on the blank paper

When the coloring opacity of the pigment is higher, the brightness on the black paper is higher while the brightness on the blank paper is lower.

When the coloring opacity of the pigment is lower to the contrary, since the influence of the black paper is higher, the brightness on the black paper is lower, and the brightness is higher on the blank paper.

Measuring Method for Maximum Particle Diameter and Average Particle Diameter

For the measurement, a particle size analysis meter MICROTRAX-UPA (made by Nikkiso Co., Ltd.) which uses a dynamic light scattering method as a measurement principle thereof is used. Glycerin 20% solution to which a surfactant is added is used as a dispersion medium in the measurement. After the infrared light absorbent is added thereto, ultrasonic vibration is given thereto until no particle association remains there, and, thus, a measurement sample is obtained.

Then, the sample is set in the measurement machine, a back scattering of laser light is detected, and the maximum diameter of particle, and the average diameter of particle are obtained through numerical processing of the detected value.

Measuring Method for Specific Surface Area

Measurement of specific surface area according to the BET method is performed as follows: $N_2$ gas which is an inactive gas is used as an adsorption gas, and a high precision automatic specific surface area measurement apparatus Gemini2360 (made by Micromeritics Co., Ltd.) is used. The conditions in the measurement are as follows:

The amount of sample: approximately 0.5 g;

Pretreatment (degassing method): drying under reduced pressure for 2 hours at a normal temperature; and Analysis method: BET multi-point method Method of Numerical Representation of Light-To-Heat Conversion Effect by Photo-Acoustic Spectroscopic Analysis (PAS)

For example, as the binder resin, polyester resin having the melting point of 114° C. is used, and the toner having the central particle diameter of 8.0 through 9.0 micrometers to which 0.5 wt % of the infrared light absorbent is added is produced (to this toner, no material other than the infrared light absorbent is added).

Then, after this toner is placed onto a stainless steel plate, an photo-acoustic spectroscopic analysis (PAS) measurement unit is set and the atmosphere is replaced by helium gas on the condition of 10 ml/s and 10 s, and, for the range between 700 and 2000 nm, measurement is made using a Fourier transform infrared spectrophotometer JIR SPX60 (made by Japan Electronics Co. Ltd.). The number of integration is 200. From the PAS intensity obtained by integration through the range between 700 and 2000 nm of infrared PAS spectrum, a relative intensity is obtained assuming that the intensity for the surface of the carbon black is 1.

Elementary Analysis Method for Neighborhood of Toner Surface by SIMS

After placing the toner particles homogeneously and thinly on an adhesion double-sided tape, loose pressurization is performed thereon, and thus, a thin film of toner is formed on the double-sided adhesion tape. Thus, the thus-obtained film is used as a measurement sample. Then, for the sample, difference in concentration/density of the inferred light absorbent contained in the toner through a range between the surface and the center thereof is measured assuming that the central metal M contained in the infrared light absorbent is regarded the label substance, using a secondary ion mass analysis apparatus PHI ADEPT1010 (made by Ulvac-Phi Incorporated), for example.

Light Absorbing Performance Measuring Method of Naphthalocyanine Compound by IR Method First, a substance to be measured is made to have particles having a desired particle size. Then, acrylic resin, Delpet 80N (made by Asahikasei Corporation) dissolved into a mixture solution of toluene/methyl-ethyl-ketone in 50:50 is used as a dispersion medium. Thereby, a homogeneous suspension of solution having a concentration of 1 wt % is prepared. This suspension is coated onto a quartz glass substrate by using a spincoater SPINNER 1H-3-A (made by Kyoei Semiconductor Co., Ltd.). Then, after drying it, absorbance for each wavelength is measured by using a Fourier transform infrared spectrophotometer JIR SPX60 (made by Japan Electronics Co. Ltd.).

Measurement Method on Particle Size (Feret Circle Equivalent Diameter) of Infrared Light Absorbent Particles in Toner First, by means of a microtome, a toner particle was cut open, and, thus, a very thin slice was prepared. Then, by means of a transmission-type electron microscope (H7500, made by Hitachi), while the view is changed, ten transmission-type electron microscope photographs were taken at a magnification of 20,000 times, Then, after that, the images thereof were taken into an image analysis device (a dot analyzer, DA5000S, made by Ohji Measurement Instrument), and then, image analysis was performed. Based on this analysis, the Feret circle equivalent diameter and cross-sectional area of the infrared light absorbent particles was obtained.

The above-mentioned Feret circle equivalent diameter means the average diameter of diameters measured from projections taken along eight directions of 0, 22.5, 45, 67.5, 90, −22.5, −45, −67.5 degrees.

Then, examples of manufacture of toner according to the present invention will now be described, one by one.

Method of Preparing Phthalocyanine Family Compound used as Infrared Light Absorbent and Method of Atomizing It The phthalocyanine family compound of the above-mentioned chemical formula (1) and/or (2) which is used as the infrared light absorbent in the toner can be produced by causing a reaction between phthalodinitryl compound and/or naphthalodinitryl compound expressed by the chemical formula (4) and/or (5) shown below, and a metal or a metal derivative, under basic condition, in a suitable solvent, preferably in an organic solvent having a boiling point of 130° C. or higher, at 100 through 300° C.

Chemical formula (4)

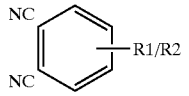

Chemical formula (5)

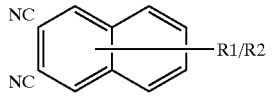

(However, R1/R2 in the above-mentioned chemical formulas has a meaning the same as that noted for the above-mentioned chemical formulas (1) and (2)) In addition, in the above-mentioned chemical formula (1) and/or (2), the central element M may be of a metal or a metal compound. For example, M may be Al, Si, Ti, V, Mn, Fe, Co, Ni, Cu, Zn, Ge, Ru, Rh, Pd, In, Sn, Pt, Pb, Mg, Ca, Ba, Be, Cd, Hg, or, halogenide, carboxylate, sulfate, nitrate, carbonyl compound, oxide, complex thereof, or the like.

Especially, halogenide or carboxylate of a metal may be preferably used. For example, copper chloride, copper bromide, copper iodide, nickel chloride, nickel bromide, nickel acetate, cobalt chloride, cobalt bromide, cobalt acetate, iron chloride, zinc chloride, zinc bromide, zinc iodide, zinc acetate, vanadium chloride, vanadium oxytrichloride, palladium chloride, acetate palladium, aluminum chloride, manganese chloride, manganese acetate, acetylacetone manganese, manganese chloride, lead chloride, lead acetate, indium chloride, titanium chloride, tin chloride, or the like may be used.

The manufacturing method for the naphthalocyanine compound, for example, will now be describe further in detail. The amount of metal or metal compound to be used is 0.2 through 0.6 times in mole, preferably, 0.25 through 0.40 times in mole, for the dicyanonaphthalene derivative in the chemical formula (4).

As the solvent used in the reaction, it is preferable to use an organic solvent having a boiling point of 100° C. or high, more preferably, 130° C. or more. For example, an alcoholic solvent such as n-amyl alcohol, n-hexanol, cyclohexanol, 2-methyl-1-pentanol, 1-heptanol, 2-heptanol, 1-octanol, 2-ethyl hexanol, benzyl alcohol, ethylene glycol, propylene glycol, ethoxyethanol, propoxyethanol, butoxyethanol, dimethylaminoethanol, and diethylaminoethanol or the like, or a high-boiling-point solvent such as trichlorobenzene, chloronaphthalene, sulfolane, nitrobenzene, quinoline, N,N-dimethylfolmamide, N-methyl-2-pyrrolidone, N,N-dimethylimidazolidinon, N,N-dimethylacetamide, urea or the like.

The amount of the above-mentioned solvent to be used is such that 1 through 100 times in weight, preferably, 5 through 20 times in weight for dicyanonaphthalene derivative.

At an occasion of the reaction, ammonium molybdate or DBU (1,8-diazabicyclo[5.4.0]-undecene) may be added as a catalyst. The amount to be added is 0.1 through 10 moles, preferably, 0.5 through 2.0 moles for one mole of dicyanonaphthalene derivative. The reaction temperature in this occasion is 100 through 300° C., preferably, 130 through 220° C.

After the reaction, the solvent is removed by distillation, or the reaction liquid is discharged into a poor solvent for the phthalocyanine family compound so as to filter out a deposited matter. Thereby, the objective compound is obtained.

Furthermore, the phthalocyanine family compound in higher purity can be obtained by refining by re-crystallization or column chromatography.

In addition, an atomizing method for the above-mentioned phthalocyanine family compound is not limited especially as long as grinding to produce particles having a desired fine particle state can be made. For example, a mechanical grinding method such as that by using a hammer mill, an air collision grinding method such as that by using a jet mill, a wet grinding method such as that by using an attriter or a wet ball mill, may be used solely or in any combination thereof.

As the infrared light absorbent according to the present invention, other than the above-mentioned phthalocyanine and/or naphthalocyanine compounds or the like, aminium salts, diiomonium salts, indium-oxide-family metal oxides, tin-oxide-family metal oxides, zinc-oxide-family metal oxides, cadmium stannate, a merocyanine pigment, a polymethine pigment, a specific amide compound, a lanthanoid compound, a thiol nickel complex, etc may be applied.

Manufacture of Dispersion Resin including Infrared Light Absorbent through Dispersion Process The resin for dispersion and infrared light absorbent are weighted out, and are put into an open-type kneader (KH-3S, made by Inoue Seisakusho), and, then, are kneaded for 60 minutes under a kneading temperature of 120° C. Thereby, a resin having the infrared light absorbent finely dispersed therein is obtained.

Production of Toner

It is possible to perform production of toner by an ordinary toner production method. When producing the toner by a grinding method, toner elements, i.e., the binder resin, above-mentioned phthalocyanine family compound as the infrared light absorbent, wax composite, colorant, electrification control agent, etc. are prepared in a mixture thereof. Then, these toner elements are fused and kneaded by a kneader, extruder or the like. After the fused and kneaded product is roughly ground, it is finely ground by a jet mill or the like, and, then, by an air classification machine, the toner particles having a desired particle size are obtained. Furthermore, processing which adds the external additive is performed, and thus, the final toner is obtained.

The toner may also be produced by a polymerization method, and, in this case, mainly a suspension polymerization method or an emulsion polymerization method may be used.

When the suspension polymerization method is used, a monomer composite is prepared by mixing a monomer such as styrene, butyl acrylate, 2-ethyl hexyl acrylate or the like, a crosslinking agent such as divinyl benzene or the like, a chain transfer agent such as dodecylmercaptan, the colorant, electrification control agent, above-mentioned phthalocyanine family compound, wax composite, a polymerization initiator, etc. Then, the above-mentioned monomer composite is put into a water phase containing a surfactant and a suspension stabilizer, such as tricalcium phosphate, polyvinyl alcohol or the like. Then, an emulsion is produced therefrom by using a rotor-and-stator type emulsification machine, a high-pressure emulsification machine, an ultrasonic emulsification machine, etc., and then, by heating, polymerization of the monomer is performed. After the polymerization, the particles are washed, and dried. Then, the external additive is added thereto, and, thus, the final toner particles are obtained. When the emulsion polymerization method is used, a monomer such as styrene, butyl acrylate, 2-ethyl hexyl acrylate or the like, and, as the demand arises, a surfactant such as sodium dodecylsulfate, are added to water in which a water soluble polymerization initiator such as potassium persulfate is dissolved. Then, the thus-obtained product is stirred and heated. Thus, polymerization is performed, and thus, resin particles are obtained. Then, in a suspension in which the resin particles are dispersed, powders such as the above-mentioned phthalocyanine family compound, colorant, electrification control agent, wax composite and so forth are added. Then, pH, stirring power, temperature, etc. of the suspension are adjusted, and, thereby, the resin particles, the infrared light absorbent powders and so forth are made hetero-aggregated.

Further, the system is heated over the glass transition temperature of the resin, and the hetero aggregate is made fused. Thus, the toner particles are obtained. Then, the particles are washed and dried. Then, the external additive is added, and the final toner particles are obtained.

Below, embodiments of the color toner according to the present invention will be described. However, the present invention is not limited to the following embodiments.

First, several examples of manufacture of the infrared light absorbent will now be described.

Evaluation for the several physical properties mentioned above is performed for the infrared light absorbents manufactured by manufacture examples 1 through 7, and the evaluation results are shown in FIG. 2. FIG. 2 shows the infrared light absorbents Nos. 1 through 15.

Manufacture Example 1 of Infrared Light Absorbent/Vanadyl Naphthalocyanine 4.0 parts of naphothalenedinitryl, 0.3 parts of vanadyl oxide, 1.5 parts of DBU, and 20 parts of n-amyl alcohol were used as raw materials, and, after they were mixed, they were stirred for six hours under refluxing.

Then, after the thus-obtained product was cooled, it was discharged into 100 milliliters of methanol, and the deposit was filtered out. Then, the product was refined by column chromatography, and, thus, 2.8 parts of vanadyl naphthalocyanine was obtained.

This vanadyl naphthalocyanine is ground so as to produce fine particles having a desired specific surface area by using an air collision grinding machine and/or an attriter.

As shown in FIG. 2, in this manufacture example 1, in order to check the influence on the toner in case of using the infrared light absorbent different in specific surface area, those having nine sorts of specific surface areas were manufactured. Namely, vanadyl naphthalocyanine each having the specific surface area in the range between 1.8 and 153.2 was manufactured.

Manufacture Example 2 of Infrared Light Absorbent/Aluminum Naphthalocyanine

Aluminum naphthalocyanine was obtained in the same manner as that of the above-mentioned manufacture example 1 except that 0.3 parts of vanadyl oxide which was a part of the raw materials was changed into the same chemical equivalent of aluminum chloride.

Manufacture Example 3 of Infrared Light Absorbent/Tin Naphthalocyanine

Tin naphthalocyanine was obtained in the same manner as that of the above-mentioned manufacture example 1 except that 0.3 parts of vanadyl oxide which was a part of the raw materials was changed into the same chemical equivalent of tin chloride.

Manufacture Example 4 of Infrared Light Absorbent/Titanyl Naphthalocyanine

Titanyl naphthalocyanine was obtained in the same manner as that of the above-mentioned manufacture example 1 except that 0.3 parts of vanadyl oxide which was a part of the raw materials was changed into the same chemical equivalent of titanium oxide.

Manufacture Example 5 of Infrared Light Absorbent/Alkoxyalkyl-substituted Vanadyl Phthalocyanine Alkoxyalkyl-substituted vanadyl phthalocyanine was obtained in the same manner as that of the above-mentioned manufacture example 1 except that 4.0 parts of naphthalenedinitryl which was a part of the raw materials was changed into the same chemical equivalent of alkoxyalkyl-substituted phthalodinitryl shown in the following chemical formula (6):

Chemical Formula (6)

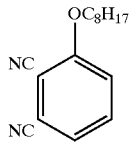

Manufacture Example 6 of Infrared Light Absorbent/Heterogeneous-skeleton naphthalocyanine A mixture of naphthalocyanine family compound having a substituent structure in which each pair of substituents of R1 and R2, R3 and R4, R5 and R6, and R7 and R8 in the above-mentioned chemical formula (1) is either:

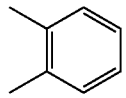

or a pair of hydrogen and a group of —$OC_8H_{17}$ was obtained in the same manner as that of the above-mentioned manufacture example 1 except that 2.0 parts of naphthalenedinitryl of 4.0 parts of naphthalenedinitryl was changed into the same chemical equivalent of alkoxyalkyl-substituted phthalodinitryl shown in the above-mentioned chemical formula (6).

Manufacture Example 7 of Infrared Light Absorbent/Alkoxyalkyl-Substituted Vanadyl Naphthalocyanine Alkoxyalkyl-substituted vanadyl naphthalocyanine was obtained in the same manner as that of the above-mentioned manufacture example 1 except that 4.0 parts of naphthalenedinitryl which was a part of the raw materials was changed into the same chemical equivalent of alkoxyalkyl-substituted naphthalenedinitryl shown in the following chemical formula (7):

Chemical Formula (7)

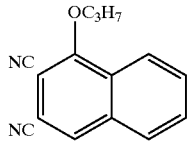

Next, examples of manufacturing the color toners for the flash fixing using the above-mentioned infrared light absorbent will now be described. These toners are shown in FIG. 3.

TONER MANUFACTURE EXAMPLE 1

(Yellow Toner/Vanadyl Naphthalocyanine 0.75 wt %/Specific Surface Area: 1.8

First, 2.0 moles of polyoxypropylene (2)-2, 2-bis (4-hydroxyphenyl) propane, 1.5 moles of polyoxyethylene (2)-2, 2-bis (4-hydroxyfenyl) propane, 2.46 moles of 1,3-butanediol, 0.12 moles of epikote 1001, 3.6 moles of terephthalic acid, 1.8 moles of isophthalic acid, 0.1 moles of anhydrous trimellitic acid, and 2.3 g of n-butyl tin oxide were put into 4-mouth flask made of glass. A thermometer, a stirring rod, a condenser, and a nitrogen introduction pipe were attached to this flask. Then, in an electric heating mantle, the mixture was stirred under a nitrogen gas flowing state, at 220° C., and, thus, a reaction was caused to occur. Then, when it reached a softening point of 114° C., the condensation polymerization reaction is terminated, and, thus, a light-yellow transparent solid-like polyester resin having the acid value of 30 mg/KOH and softening point of 114° C. was obtained.

The polyester resin manufactured by the above-mentioned method was used as the binder resin. Thereto, 5 wt % of benzimidazolon pigment (toner yellow HG, made by Clariant Co. Ltd.), 0.8 wt % of Calixarene compound (E-89, made by Orient Chemistry Co., Ltd.) and 0.75 wt % of the infrared light absorbent No. 1 shown in FIG. 2 were added. After fusion and kneading thereof were performed using 2-axis extruder (PCM-30, made by IKEGAI Co., Ltd.), fine grinding thereof was performed using a grinding and classification unit (made by Japan Pneumatic Co., Ltd.) which consists of a jet mill and a DS classification device. Thus, a toner host product is obtained.

Then, to the toner host product, as the external additive, 0.35 weight parts of hydrophobic silica (H-2000, made by Clariant Co., Ltd.) was added by using an Henshel mixer, and thus, the toner (A) was obtained.

TONER MANUFACTURE EXAMPLE 2

(Yellow Toner/Vanadyl Naphthalocyanine 0.75 wt %/Specific Surface Area: 19.1

The toner (B) was obtained in the same manner as that of the above-described toner manufacture example 1 except changing the infrared light absorbent to be added into the No. 2 shown in FIG. 2.

TONER MANUFACTURE EXAMPLE 3

(Yellow Toner/Vanadyl Naphthalocyanine 0.75 wt %/Specific Surface Area: 29.6

The toner (C) was obtained in the same manner as that of the above-described toner manufacture example 1 except changing the infrared light absorbent to be added into the No. 3 shown in FIG. 2.

TONER MANUFACTURE EXAMPLE 4

(Yellow Toner/Vanadyl Naphthalocyanine 0.75 wt %/Specific Surface Area: 46.6

The toner (D) was obtained in the same manner as that of the above-described toner manufacture example 1 except changing the infrared light absorbent to be added into the No. 4 shown in FIG. 2.

TONER MANUFACTURE EXAMPLE 5

(Yellow Toner/Vanadyl Naphthalocyanine 0.75 wt %/Specific Surface Area: 58.3

The toner (E) was obtained in the same manner as that of the above-described toner manufacture example 1 except changing the infrared light absorbent to be added into the No. 5 shown in FIG. 2.

TONER MANUFACTURE EXAMPLE 6

(Yellow Toner/Vanadyl Naphthalocyanine 0.75 wt %/Specific Surface Area: 83.3

The toner (F) was obtained in the same manner as that of the above-described toner manufacture example 1 except changing the infrared light absorbent to be added into the No. 6 shown in FIG. 2.

TONER MANUFACTURE EXAMPLE 7

(Yellow Toner/Vanadyl Naphthalocyanine 0.75 wt %/Specific Surface Area: 118.2

The toner (G) was obtained in the same manner as that of the above-described toner manufacture example 1 except changing the infrared light absorbent to be added into the No. 7 shown in FIG. 2.

TONER MANUFACTURE EXAMPLE 8

(Yellow Toner/Vanadyl Naphthalocyanine 0.75 wt %/Specific Surface Area: 132.1

The toner (H) was obtained in the same manner as that of the above-described toner manufacture example 1 except changing the infrared light absorbent to be added into the No. 8 shown in FIG. 2.

TONER MANUFACTURE EXAMPLE 9

(Yellow Toner/Vanadyl Naphthalocyanine 0.75 wt %/Specific Surface Area: 153.2

The toner (I) was obtained in the same manner as that of the above-described toner manufacture example 1 except changing the infrared light absorbent to be added into the No. 9 shown in FIG. 2.

TONER MANUFACTURE EXAMPLE 10

(Yellow Toner/Aluminum Naphthalocyanine 0.75 wt %/Specific Surface Area: 60.3

The toner (J) was obtained in the same manner as that of the above-described toner manufacture example 1 except changing the infrared light absorbent to be added into the No. 10 shown in FIG. 2.

TONER MANUFACTURE EXAMPLE 11

(Yellow Toner/Tin Naphthalocyanine 0.75 wt %/Specific Surface Area: 55.4

The toner (K) was obtained in the same manner as that of the above-described toner manufacture example 1 except changing the infrared light absorbent to be added into the No. 11 shown in FIG. 2.

TONER MANUFACTURE EXAMPLE 12

(Yellow Toner/Titanyl Naphthalocyanine 0.75 wt %/Specific Surface Area: 60.7

The toner (L) was obtained in the same manner as that of the above-described toner manufacture example 1 except changing the infrared light absorbent to be added into the No. 12 shown in FIG. 2.

TONER MANUFACTURE EXAMPLE 13

(Yellow Toner/Vanadyl Phthalocyanine 0.75 wt %/Specific Surface Area: 63.2

The toner (M) was obtained in the same manner as that of the above-described toner manufacture example 1 except changing the infrared light absorbent to be added into the No. 13 shown in FIG. 2.

TONER MANUFACTURE EXAMPLE 14

(Yellow Toner/Heterogeneous-Skeleton Vanadyl naphthalocyanine 0.5 wt %/Specific Surface Area: 50.2

The toner (N) was obtained in the same manner as that of the above-described toner manufacture example 1 except changing the infrared light absorbent to be added into the No. 14 shown in FIG. 2, and the additive amount thereof is made 0.5 wt %.

TONER MANUFACTURE EXAMPLE 15

(Yellow Toner/Vanadyl Naphthalocyanine 0.05 wt %/Specific surface area: 46.6

The toner (O) was obtained in the same manner as that of the above-described toner manufacture example 1 except changing the amount of the infrared light absorbent to be added into 0.05 wt %.

TONER MANUFACTURE EXAMPLE 16

(Yellow Toner/Vanadyl Naphthalocyanine 0.30 wt %/Specific Surface Area: 46.4

The toner (P) was obtained in the same manner as that of the above-described toner manufacture example 1 except changing the amount of the infrared light absorbent to be added into 0.30 wt %.

TONER MANUFACTURE EXAMPLE 17

(Yellow Toner/Vanadyl Naphthalocyanine 0.50 wt %/Specific Surface Area: 46.6

The toner (Q) was obtained in the same manner as that of the above-described toner manufacture example 1 except changing the amount of the infrared light absorbent to be added into 0.50 wt %.

TONER MANUFACTURE EXAMPLE 18

(Yellow Toner/Vanadyl Naphthalocyanine 3.0 wt %/Specific Surface Area: 46.6

The toner (R) was obtained in the same manner as that of the above-described toner manufacture example 1 except changing the amount of the infrared light absorbent to be added into 3.0 wt %.

TONER MANUFACTURE EXAMPLE 19

(Yellow Toner/Vanadyl Naphthalocyanine 6.0 wt %/Specific Surface Area: 46.6

The toner (S) was obtained in the same manner as that of the above-described toner manufacture example 1 except changing the amount of the infrared light absorbent to be added into 6.0 wt %.

TONER MANUFACTURE EXAMPLE 20

(Red Toner/Vanadyl Naphthalocyanine 0.75 wt %/Specific Surface Area: 46.6

The toner (T) was obtained in the same manner as that of the above-described toner manufacture example 1 except changing the pigment to be added from 5 wt % of benzimidazolon pigment (toner yellow HG, made by Clariant Co., Ltd.) into an azo pigment in a family of naphthol (Irgalite Red 3RS, made by Chiba Co., Ltd.).

TONER MANUFACTURE EXAMPLE 21

(Red Toner/Alkyl-Substituted Vanadyl Naphthalocyanine 0.75 wt %/Specific Surface Area: 53.2

The toner (U) was obtained in the same manner as that of the above-described toner manufacture example 1 except changing the infrared light absorbent to be added into the No 15 shown in FIG. 2.

Next, a method of evaluating the toners in the embodiments will now be described.

Each of the above-mentioned toners (A) through (U) was used for producing two-ingredient developer, and, then, by using an image forming apparatus 1 having a configuration as will now be described, the color tone, fixing performance, image characteristics and so forth were measured, and, then, based thereon, judgement was made from a general view point.

Figure 5:
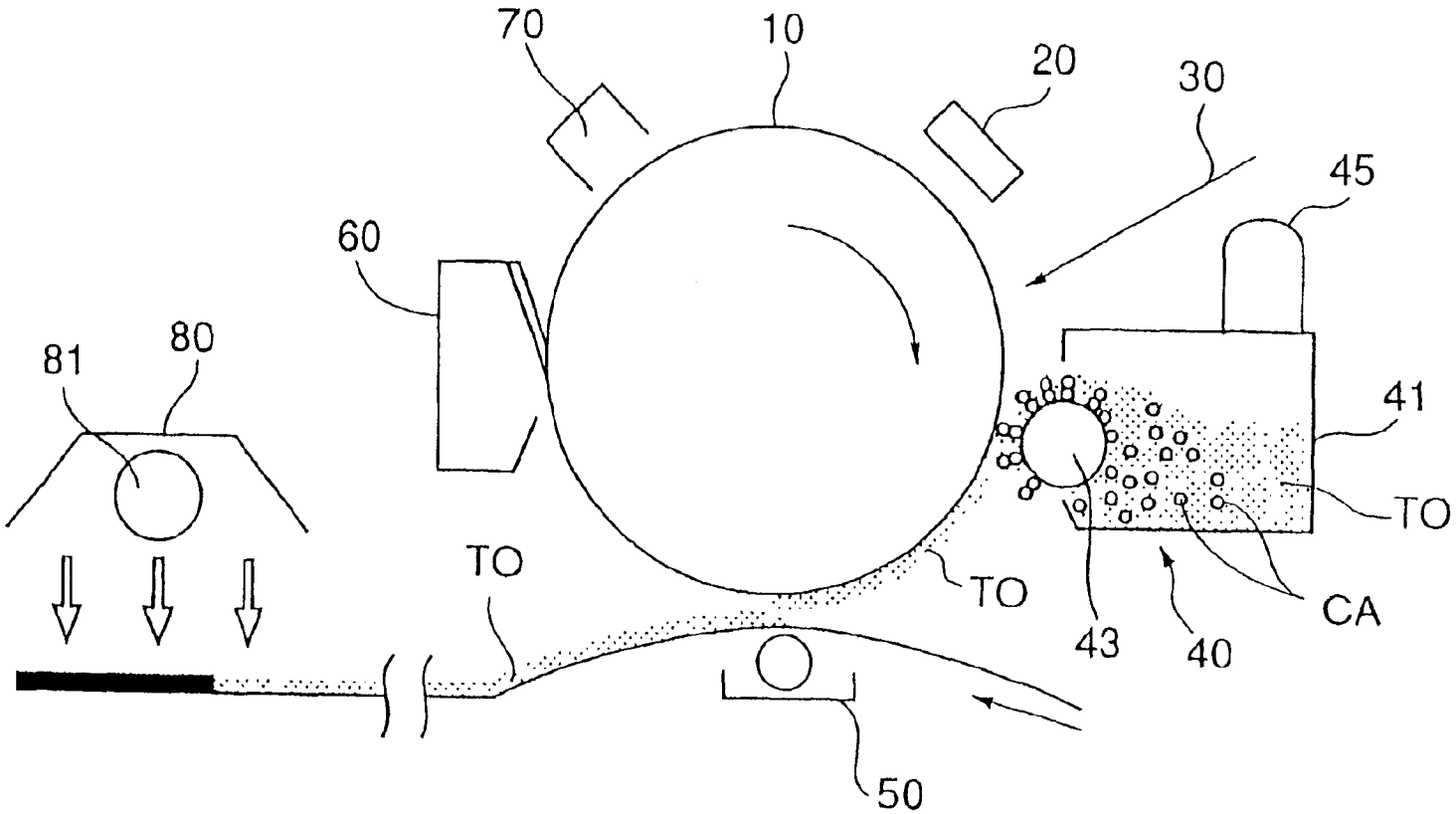
FIG. 5 shows a general partial configuration of a two-ingredient-developing-type image formation apparatus typically.

FIG. 5 typically and partially shows a general configuration of the image formation apparatus 1 in two-ingredient developing system. This apparatus 1 is of a high-speed development type having a process speed of 1152 mm/s, and, wherein, in the periphery of a photosensitive body 10 made of amorphous silicon, an electrification unit 20, an exposure unit 30, a development unit 40, a transfer unit 50, a cleaner 60, an electric discharge unit 70, and a flash fixing unit 80 including a xenon flash lamp 81 are arranged.

The development unit 40 includes a developer container 41, a development roller 43, stirring blades (not shown in the figure) and so forth, causes toner particles TO and carrier particles CA in the developer container 41 to come into contact together so that a predetermined amount of electrification is given to the toner. Image formation is performed wherein each of the above-mentioned toners (A) through (U) was used in the two-ingredient developer in the apparatus 1.

Toner Evaluation Method

Each of the above-mentioned toners (A) through (U) was mixed with a ferrite carrier having a particle diameter of 60 micrometers, and formed into a developer at 4.5% in toner concentration. Then, it was loaded into a modified version of a printer (of a product number of PS2160, made by FUJITSU LTD.) having the same configuration as that of the image forming apparatus 1 described above with reference to FIG. 5. Then, the xenon flash light (irradiation energy of $2.2/cm^2$) was applied, and a printed image was obtained as a result of being fixed onto an ordinary paper (NIP-1500LT, made by Kobayashi Recording Paper Co., Ltd.).

Next, the fixing performance thereof was examined as follows:

First, an optical density (OD1) was measured for the printed image having a size of 1 inch by 1 inch, after that, an adhesion tape (Scotch Mending Tape, made by Sumitomo 3M Co., Ltd.) was made stuck onto this printing image, the tape was torn off therefrom after elapsing an appropriate time, and then, an optical density (OD2) of the printed image after exfoliation was measured. Then the performance of fixing of the printed image was computed therefrom by the following formula:

$$\text{Fixing performance (\%)} = OD2/OD1 \times 100$$

A Macbeth PCM meter was used for the measurement of the optical density.

Next, visual evaluation was performed for the color tone of the printed image, and sensual evaluation was performed for a degree of color muddiness caused by addition of the infrared light absorbent. With regard to results of the evaluation, ◎ was given to an especially superior one, ○ was given to a superior one, Δ was given to one which was not completely in a practical level, × was given to one which was completely lower than the practical level, and ×× was given to one which was further lower than the practical level (total five steps).

Moreover, for the printed image, 5-step evaluation by viewing with human eyes was performed from a general point of view of image characteristics such as for degradation of brightness in a background white part, dirt, etc., similarly to the above-mentioned case of examination for the color tone.

The above-mentioned evaluation results are shown in FIG. 3. From FIG. 3, the following facts can be seen:

(1) When the coloring opacity exceeds 20, the color tone is problematically influenced thereby. Accordingly, it is preferable to set the coloring opacity below this level. For example, the toner D had the infrared light absorbent No. 4 added thereto, the color tone was in an approximately in the practical use level. In fact, the coloring opacity of this No.4 infrared light absorbent was 16.

Moreover, it can be seen from the results of the toners E through K, as for the coloring opacity, it is more preferable to set it equal to or less than 15. The coloring opacity of the infrared light absorbent falls according to the specific surface area, however, is saturated around a range in which the specific surface area exceeds approximately 80 $m^2/g$.

Moreover, it can also be seen from comparison of the results of the toners E, J, K and L that the coloring opacity can be reduced if aluminum or tin is used as the central metal M of the phthalocyanine family compound, and the color tone can be improved accordingly.

(2) From the evaluations for the toners A through I using vanadyl naphthalocyanine having different values in specific surface area as the infrared light absorbents, the following facts can be seen:

(a) The fixing performance and image color tone can be improved when the specific surface area of the infrared light absorbent is large. This improvement is especially remarkable for the specific surface area in a range between 1 and 40.

(b) The specific surface area of the infrared light absorbent which can provide preferable fixing performance, color tone, and image characteristics is equal to or higher than approximately 40.0 $m^2/g$.

(c) As the specific surface area of the infrared light absorbent used is further increased, the improvement effect for the fixing performance and image color tone tends to be saturated, and, especially the fixing performance rather tends to be degraded. Further, in consideration of the costs required for grinding to produce finer particles in manufacturing of the infrared light absorbent, it is preferable that the specific surface area of the infrared light absorbent does not exceed 120.0 $m^2/g$.

(3) Next, it can be seen from comparison for the fixing performance between the toners N and Q, that:

it is effective in toner fixing performance to appropriately modify the skeleton structure of the phthalocyanine family compound, and broaden the absorption frequency band thereof.

(4) Furthermore, from comparison between the toners O through S, the optimal amount of addition of the infrared light absorbent is in a range between 0.1 and 5.0 wt %, and, further preferably, in a range between 0.2 and 3.0 wt %.

(5) The toners T and U show that the toners in the embodiments of the present invention can be satisfactorily used also for red other than yellow. In addition, a good result can be similarly obtained also for colors other than red, for example, blue, green, vermilion, and so forth. Of course, the present invention can also be applied to a black toner.

Further, embodiments especially directed to the infrared light absorbent dispersed in the toner will now be described. Specifically, toners (a) through (g) were produced, and therefor, relationship between each toner and infrared light absorbent contained therein, and evaluation results will be shown.

The infrared light absorbent used in each embodiment described below is one type produced as follows:

Manufacture Example of Infrared Light Absorbent/ Vanadyl Naphthalocyanine

As an original material, 4.0 parts of naphthalocyanine, 0.3 parts of vanadyl oxide, 1.5 parts of DBU, 20 parts of n-amyl alcohol were used. Then, they were mixed together, and, after that, were stirred under a condition of reflux for six hours.

After they were cooled, they were put into 100 milliliters of methanol. Then, the precipitated matter was filtered out, was refined through a column chromatography, and, thus, 2.8 parts of vanadyl naphthalocyanine were obtained.

Then, by means of an air collision grinding machine and/or an attriter grinder, the vanadyl naphthalocyanine was ground so as to produce fine particles each having a desired specific surface area.

TONER MANUFACTURE EXAMPLE 1

First, 2.0 moles of polyoxypropylene (2)-2, 2-bis (4-hydroxyphenyl) propane, 1.5 moles of polyoxyethylene (2)-2, 2-bis (4-hydroxyfenyl) propane, 2.46 moles of 1,3-butanediol, 0.12 moles of epikote 1001, 3.6 moles of telephthalic acid, 1.8 moles of isophthalic acid, 0.1 moles of anhydrous trimellitic acid, and 2.3 g of n-butyl tin oxide were put into a 4-mouth flask made of glass. A thermometer, a stirring rod, a condenser, and a nitrogen introduction pipe were attached to this flask. Then, in an electric heating mantle, the mixture was stirred under a nitrogen gas flown state, at 220° C., and, thus, a reaction was caused to occur. Then, when it reached a softening point of 114° C., the condensation polymerization reaction was terminated, and, thus, a light-yellow transparent solid-like crosslinked polyester resin A (binder resin) having the acid value of 30 mg/KOH and the softening point of 114° C. was obtained.

Then, similarly, a monomer made of 3.5 moles of 1, 2 propane diol, 2.2 moles of neopentyl glycol, 5.1 moles of diethyl telephthalic acid and 0.8 moles of isophthalic acid was made to perform condensation polymerization reaction. Thus, a light-yellow transparent solid-like non-crosslinked polyester resin B (dispersion resin) having the acid value of 7 mg/KOH and the softening point of 112° C. was obtained. Then, vanadyl naphthalocyanine (specific surface area of 3.2 m2/g; maximum particle diameter of 32 $\mu$m) was added to the thus-obtained non-crosslinked polyester resin B, and, then, the thus-obtained matter was put into an open-type kneader (KH-3S, made by Inoue Seisakusho). After that, the relevant matter is made to be kneaded for 60 minutes under the kneading temperature of 120° C., and, thus, a resin kneaded mixture $\alpha$ having a vanadyl naphthalocyanine content of 1.2 wt % was obtained (dispersion process).

Then, 40 wt % of the above-mentioned resin kneaded mixture $\alpha$, 53 wt % of crosslinked polyester resin A, 5 wt % of benzimidazolon pigment (toner yellow HG, made by Clariant Co. Ltd.), 0.8 wt % of Calixarene compound (E-89, made by Orient Chemistry Co., Ltd.) and 1.2 wt % of polypropylene wax (NP-105, made by Mitsui Chemical) were weighted out and mixed. After that, fusion and kneading thereof was performed using a 2-axis extruder (PCM-30, made by IKEGAI Co., Ltd.), finely grinding thereof was performed using a grinding and classification unit (made by Japan Pneumatic Co., Ltd.) which consists of a jet mill and a DS classification device. Thus, a toner host product 1 was obtained (preparation process).

Then, to the toner host product 1, as an external additive, 0.35 weight parts of hydrophobic silica (H-2000, made by Clariant Co., Ltd.) was added by using an Henshel mixer, and thus, a toner (a) was obtained.

TONER MANUFACTURE EXAMPLE 2

93 wt % of paraffin wax (HNP-10, Nippon Seiro), 6 wt % of N, N, N', N'-tetrakis (p-dibutyl-amino) p-phenylendiamine diiomonium perchlorate (NIR-1600, made by Teikoku Chemical), and 1.0 wt % of solbitan aliphatic ester (ionet S-85, made by Sanyo Chemical Industry) were kneaded by means of an open-type kneader as in the case of the above-mentioned toner manufacture example 1. Thus, a wax kneaded mixture $\beta$ was obtained.

Then, 35 wt % of the above-mentioned resin kneaded mixture a, 5 wt % of wax kneaded mixture $\beta$, 53 wt % of crosslinked polyester resin A, 5 wt % of benzimidazolon pigment (toner yellow HG, made by Clariant Co. Ltd.), 0.8 wt % of Calixarene compound (E-89, made by Orient Chemistry Co., Ltd.) and 1.2 wt % of polypropylene wax (NP-105, made by Mitsui Chemical) were weighted out and mixed. After that, fusion and kneading thereof was performed using a 2-axis extruder (PCM-30, made by IKEGAI Co., Ltd.), finely grinding thereof was performed using a grinding and classification unit (made by Japan Pneumatic Co., Ltd.) which consists of a jet mill and a DS classification device. Thus, a toner host product 2 was obtained (preparation process).

Then, to the toner host product 2, as an external additive, 0.35 weight parts of hydrophobic silica (H-2000, made by Clariant Co., Ltd.) was added by using an Henshel mixer, and thus, a toner (b) was obtained.

TONER MANUFACTURE EXAMPLE 3

To the non-crosslinked polyester resin B produced in the manner same as in the case of the above-mentioned toner manufacture example 1, ytterbium oxide having the average particle diameter of 1 $\mu$m, specific surface area of 5.1 m2/g, and maximum particle diameter of 8 $\mu$m (RU, made by ShinEtsu RareEarth) was added, and, then, as in the case of the toner manufacture example 1, a resin kneaded mixture y containing 20 wt % of ytterbium oxide in concentration was obtained.

Then, 20 wt % of the above-mentioned resin kneaded mixture $\alpha$, 20 wt % of the above-mentioned resin kneaded mixture $\gamma$, 53 wt % of crosslinked polyester resin A, 5 wt % of benzimidazolon pigment (toner yellow HG, made by Clariant Co. Ltd.), 0.8 wt % of Calixarene compound (E-89, made by Orient Chemistry Co., Ltd.) and 1.2 wt % of polypropylene wax (NP-105, made by Mitsui Chemical) were weighted out and mixed. After that, fusion and kneading thereof was performed using a 2-axis extruder (PCM-30, made by IKEGAI Co., Ltd.), finely grinding thereof was performed using a grinding and classification unit (made by Japan Pneumatic Co., Ltd.) which consists of a jet mill and a DS classification device. Thus, a toner host product 3 is obtained.

Then, to the toner host product 3, as an external additive, 0.35 weight parts of hydrophobic silica (H-2000, made by Clariant Co., Ltd.) was added by using an Henshel mixer, and thus, a toner (c) was obtained.

TONER MANUFACTURE EXAMPLE 4/ COMPARISON EXAMPLE 1

In the same manner as in the toner manufacture example 1 except that the crosslinked polyester resin A was applied to the dispersion resin used in manufacture of the resin kneaded mixture, a toner host product 4 and a toner (d) were obtained.

TONER MANUFACTURE EXAMPLE 5/ COMPARISON EXAMPLE 2

In the same manner as in the toner manufacture example 1 except that the kneading time in manufacture of the resin kneaded mixture a was 5 minutes, a toner host product 5 and a toner (e) were obtained.

TONER MANUFACTURE EXAMPLE 6/ COMPARISON EXAMPLE 3

First, in the same manner as in the toner manufacture example 1, a resin kneaded mixture δ containing 12 wt % of vanadyl naphthalocyanine in manufacture of the resin kneading mixture was obtained.

Then, 5 wt % of the above-mentioned resin kneaded mixture δ, 88 wt % of crosslinked polyester resin A, 5 wt % of benzimidazolon pigment (toner yellow HG, made by Clariant Co. Ltd.), 0.8 wt % of Calixarene compound (E-89, made by Orient Chemistry Co., Ltd.) and 1.2 wt % of polypropylene wax (NP-105, made by Mitsui Chemical) were weighted out and mixed. After that, fusion and kneading thereof was performed using a 2-axis extruder (PCM-30, made by IKEGAI Co., Ltd.), finely grinding thereof was performed using a grinding and classification unit (made by Japan Pneumatic Co., Ltd.) which consists of a jet mill and a DS classification device. Thus, a toner host product 6 was obtained.

Then, to the toner host product 6, as an external additive, 0.35 weight parts of hydrophobic silica (H-2000, made by Clariant Co., Ltd.) was added by using an Henshel mixer, and thus, a toner (f) was obtained.

TONER MANUFACTURE EXAMPLE 7/ COMPARISON EXAMPLE 4

92.25 wt % of crosslinked polyester resin A, 0.75 wt % of vanadyl naphthalocyanine (specific surface area of 3.2 $m^2/g$; maximum particle diameter of 32 μm), 5 wt % of benzimidazolon pigment (toner yellow HG, made by Clariant Co. Ltd.), 0.8 wt % of Calixarene compound (E-89, made by Orient Chemistry Co., Ltd.) and 1.2 wt % of polypropylene wax (NP-105, made by Mitsui Chemical) were weighted out and mixed. In this case, fine grinding process of the infrared light absorbent was omitted. After that, fusion and kneading thereof was performed using a 2-axis extruder (PCM-30, made by IKEGAI Co., Ltd.), finely grinding thereof was performed using a grinding and classification unit (made by Japan Pneumatic Co., Ltd.) which consists of a jet mill and a DS classification device. Thus, a toner host product 7 is obtained.

Then, to the toner host product 7, as an external additive, 0.35 weight parts of hydrophobic silica (H-2000, made by Clariant Co., Ltd.) was added by using an Henshel mixer, and thus, a toner (g) was obtained.

Evaluation results on these toners (a) through (g) will now be described. The method of evaluation is the same as for the toners (A) through (U) in the embodiments described above.

Toner (a)

When observing the dispersion state in the infrared light absorbent included in the toner after the manufacture thereof, it was found that the toner included the resin system including the dispersion resin having the infrared light absorbent dispersed therein, and further, the binder resin having this dispersion resin scattered therein. Viewing the toner by a macroscopic manner, this toner had a 'sea-island configuration' in which the scattered dispersion resin acts as the islands while the binder resin surrounding them acts as the sea. Further, it was found out that, in a toner's very thin slice taken from the vicinity of the surface layer of the toner particle, the ratio of the dispersion resin systems containing relatively large amounts of the infrared light absorbent was high. Furthermore, the average Feret circle equivalent diameter of the infrared light absorbent particles dispersed in the dispersion resin was 0.31 μm, and, the cross-sectional area percentage of the particles having the Feret circle equivalent diameters falling within the range between 0.05 and 0.5 μm was 92%.

The fixing performance of this toner was more than 95%, and, thus, it was very satisfactory, and, also, the hue thereof was of level ○.

Toner (b)

When observing the dispersion state of the infrared absorbent contained in the toner after the manufacture of the toner, it was found that also this toner had a 'sea-island configuration' in which the dispersion resin systems and wax particles having the dispersed infrared absorbent therein were scattered as islands. Furthermore, it was found that, in a very thin toner slice taken from the vicinity of toner particle surface layer, the ratio of the dispersion resin systems and wax parts including relatively large amounts of the infrared light absorbent was high.

Further, the average Feret circle equivalent diameter of the infrared light absorbent particles (expected as being vanadyl naphthalocyanine particles) dispersed in the dispersion resin was 0.31 μm, and, the cross-sectional area percentage of the particles having the Feret circle equivalent diameters falling within the range between 0.05 and 0.5 μm was 90%. Furthermore, the average Feret circle equivalent diameter of the infrared light absorbent particles (expected as being diiomonium salt particles) dispersed in the wax was 0.30 μm, and, the cross-sectional area percentage of the particles having the Feret circle equivalent diameters falling within the range between 0.05 and 0.5 μm was 85%.

The fixing performance of this toner was more than 95%, and, thus, it was very satisfactory, and, also, the hue thereof was of level 0.

Toner (c)

When observing the dispersion state of the infrared absorbent contained in the toner after the manufacture of the toner, it was found that this toner had a 'sea-island configuration' in which two types of dispersion resins act as the islands there, and, in a very thin toner slice taken from the vicinity of the toner particle surface layer, the ratio of the dispersion resin systems including relatively large amounts of the infrared light absorbent was high. In the dispersed infrared light absorbent particles mainly dispersed in the resin system, the average Feret circle equivalent diameter of the infrared light absorbent particles expected as being vanadyl-naphthalocyanine particles dispersed in the dispersion resin was 0.33 μm, and, the cross-sectional area percentage of the particles having the Feret circle equivalent diameters falling within the range between 0.05 and 0.5 μm was 88%, while the average Feret circle equivalent diameter of the infrared light absorbent particles expected as being ytterbium oxide particles dispersed in the wax was 0.15 μm, and, the cross-sectional area percentage of the particles having the Feret circle equivalent diameters falling within the range between 0.05 and 0.5 μm was 100%.

The fixing performance of this toner was more than 95%, and, thus, it was very satisfactory, and, also, the hue thereof was of level ⊙.

Toner (d)

When observing the dispersion state of the infrared absorbent contained in the toner after the manufacture of the toner, it was found that in this toner, the infrared light absorbent particles were relatively uniformly distributed throughout the toner, the average Feret circle equivalent diameter thereof was 0.28 μm, and the cross-sectional area percentage of the particles falling within the range of Feret circle equivalent diameter between 0.05 and 0.5 μm was 95%.

The fixing performance of this toner was approximately 80%, and, thus, it was not very satisfactory, and, the hue thereof was of level ○.

Toner (e)

When observing the dispersion state of the infrared absorbent contained in the toner after the manufacture of the toner, it was found that this toner had a 'sea-island configuration' in which two types of dispersion resins acted as the islands there, and, in a very thin toner slice taken from the vicinity of the toner particle surface layer, the ratio of the dispersion resin systems including relatively large amounts of the infrared light absorbent was high. The average Feret circle equivalent diameter of the dispersed infrared light absorbent particles was 0.83 μm, and, the cross-sectional area percentage of the particles having the Feret circle equivalent diameters falling within the range between 0.05 and 0.5 μm was 36%.

The fixing performance of this toner was 65%, and, thus, it could not be put into practical use, and, the hue thereof was of level Δ.

Toner (f)

When observing the dispersion state of the infrared absorbent contained in the toner after the manufacture of the toner, it was found that this toner had a 'sea-island configuration' in which two types of dispersion resins acted as the islands there, and, the island parts included relatively high-concentration infrared light absorbent. Further, the ratio of the island parts included in a TEM image view field of a toner's very thin slice was small, and, also, there was a TEM image in which no island parts exist. Accordingly, it could be expected that the infrared light absorbent was fairly unevenly distributed in the toner. The average Feret circle equivalent diameter of the dispersed infrared light absorbent was 0.30 μm, and, the cross-sectional area percentage of the particles having Feret circle equivalent diameters falling within the range between 0.05 and 0.5 μm was 92%.

The fixing performance of this toner varied in a range between 75 and 95%, and, the hue thereof was of level Δ.

Toner (g)

When observing the dispersion state of the infrared absorbent contained in the toner after the manufacture of the toner, it was found that, in this toner, relatively large diameters of the infrared light absorbent particles were approximately uniformly dispersed, the average Feret circuit equivalent diameter thereof was 1.4 μm, and the cross-sectional area percentage of the particles having the Feret circle equivalent diameters falling within the range between 0.05 and 0.5 μm was 8%.

This toner was hardly fixed, and, thus, no numerical value of the fixing performance could be obtained. The hue thereof was of the level of ×.

From the above-described evaluation results, the following points can be seen:

First, by configuring the infrared light absorbent added to the toner such that not less than 80% in cross-sectional area of the particles have the Feret circle equivalent diameters falling within the range between 0.05 and 0.5 μm, the fixing performance and image hue, i.e., image vividness of the toner improve.

Furthermore, as to manufacture of the toner, by configuring the toner of not less than two systems of materials having different values in brittleness, previously finely dispersing the infrared light absorbent selectively in the material having a higher brittleness, and then, performing manufacture of the toner through kneading the material having the higher brittleness with the other materials having lower brittleness, the ratio or probability of existence of infrared light absorbent in the vicinity of toner particle surface layer improves, and, as a result, the fixing performance improves, and the cost can be effectively reduced.

In addition, although the above-described embodiments are those in which the two-ingredient developer using the toner according to the present invention together with the carrier, it is also possible to use a toner according to the present invention as a magnetic or a non-magnetic single-ingredient developer.

As can be seen from the detailed description above, when the amount of addition of the infrared light absorbent is made into a sufficient amount such that the fixing performance should be secured, in the color toner in the related art, for the flash fixing, the hue of the toner may be problematically affected as well as the costs may become problematically increased thereby. Accordingly, it may be difficult to achieve a practical one according to the related art for a toner of lemon yellow, for example, which color is likely be problematically influenced and in which muddiness of color tone may occur thereby.

In contrast thereto, according to the present invention, since the coloring opacity of the infrared light absorbent added to the toner is low, the infrared light absorbent hardly influences the color tone of a pigment added to the toner for the purpose of coloring of the toner. Thus, the present invention has a superior advantage.

Furthermore, since the infrared light absorbent according to the present invention also has a high light absorption capability, it is possible to effectively control/reduce the amount of addition thereof, and thus, it is possible to effectively reduce the absorption by the infrared light absorbent for the visible light wavelength zone. Therefore, the color tone of the toner can be improved also from this aspect.

Therefore, also for a color for which muddiness of color tone is likely to occur, such as lemon yellow, it is possible to provide a brightness fixed image (printed image) by using a toner according to the present invention.

Furthermore, by an image formation apparatus using such a toner according to the present invention, it is possible to provide a bright color tone.

Further, the present invention is not limited to the above-described embodiments, and variations and modifications may be made without departing from the scope of the present invention.

The present application is based on Japanese patent applications Nos. 2001-102603 and 2001-392759, filed on Mar. 30, 2001, and Dec. 25, 2001, respectively, the entire contents of which are hereby incorporated by reference.

What is claimed is:

1. A toner for optical fixing, comprising:

a binder resin;

a colorant; and an infrared light absorbent, wherein:

a coloring opacity of the infrared light absorbent is 20 or less; and the infrared light absorbent has a structure expressed by the following chemical formula (1) and/or (2);

Chemical Formula (1)

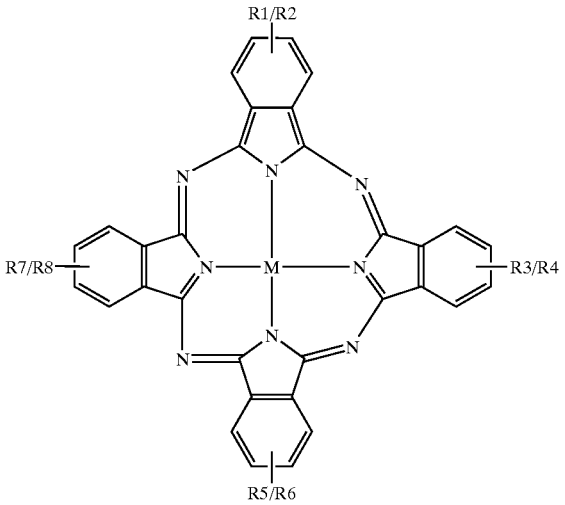

Chemical Formula (2)

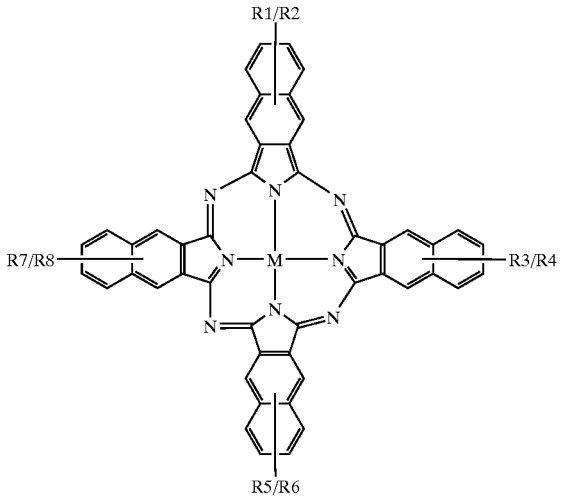

wherein:

each of R1 through R8 denotes a substituent added to a benzene ring or a naphthalene ring, and comprises a hydrogen, a halogen atom, a saturated or unsaturated hydrocarbon group having the number of carbons in a range between 1 and 18, or an oxygen and/or nitrogen content hydrocarbon group having the number of carbons in a range between 1 and 13; and M denotes two hydrogen atoms, a divalent metal, or a trivalent or tetravalent metal derivative.

2. The toner as claimed in claim 1, wherein the infrared light absorbent has a specific surface area in a range between 40.0 and 120.0 $m^2/g$ measured by a BET method.

3. The toner as claimed in claim 1, wherein the central element M in the chemical formula (1) and/or (2) comprises aluminum or tin.

4. The toner as claimed in claim 1, wherein any one or plurality of groups of R1 through R8 in the chemical formula (1) and/or (2) are different from the other groups of R1 through R8.

5. An image forming apparatus which performs image formation using the toner claimed in claim 1 as a developer in a development process.

6. A toner for optical fixing, comprising:

a binder resin;

a colorant; and an infrared light absorbent, wherein:

not less than 80% in cross-sectional area of particles of the infrared absorbent in a dispersed state in the toner have Feret circle equivalent diameters falling within a range between 0.05 and 0.5 $\mu$m; and the infrared light absorbent has a structure expressed by the following chemical formula (1) and/or (2);

Chemical Formula (1)

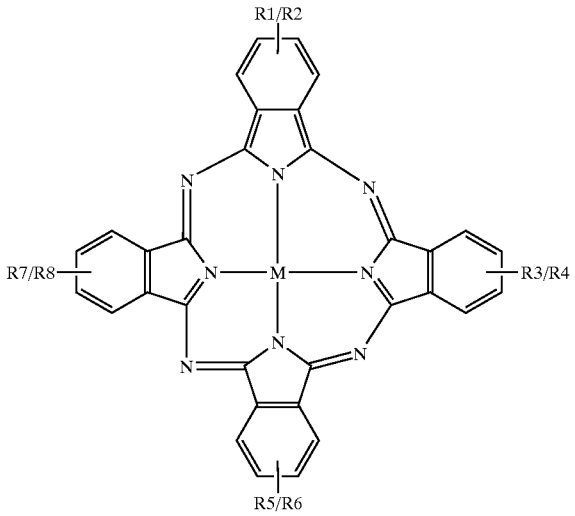

Chemical Formula (2)

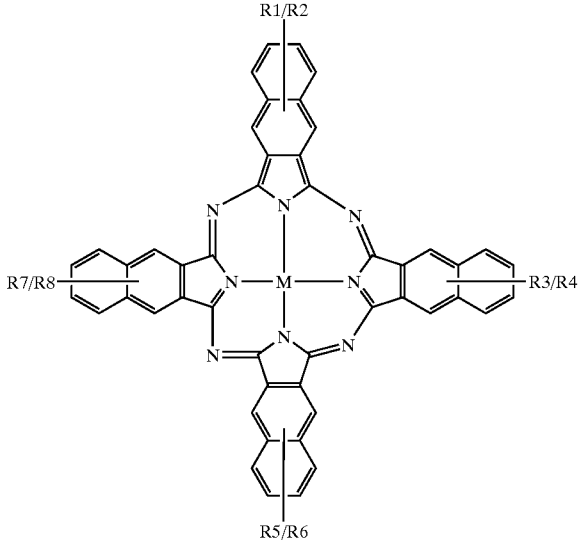

wherein:

each of R1 through R8 denotes a substituent added to a benzene ring or a naphthalene ring, and comprises a hydrogen, a halogen atom, a saturated or unsaturated hydrocarbon group having the number of carbons in a range between 1 and 18, or an oxygen and/or nitrogen content hydrocarbon group having the number of carbons in a range between 1 and 13; and M denotes two hydrogen atoms, a divalent metal, or a trivalent or tetravalent metal derivative.

7. An image forming apparatus which performs image formation using the toner claimed in claim 6 as a developer in a development process.

8. A method of manufacturing a toner for optical fixing, the toner comprising:

a binder resin;

a colorant; and an infrared light absorbent having a structure expressed by the following chemical formula (1) and/or (2):

Chemical Formula (1)

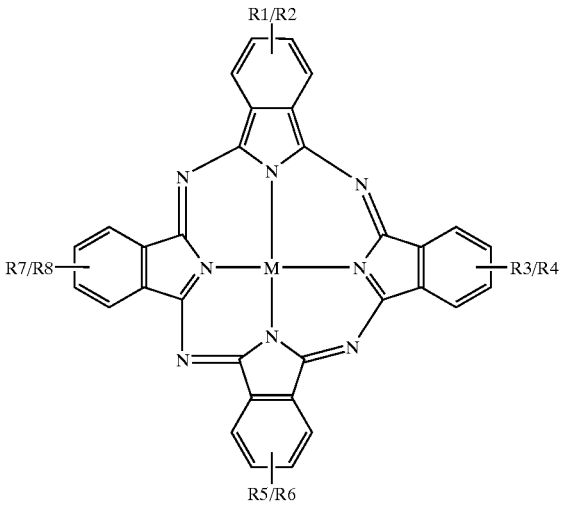

Chemical Formula (2)

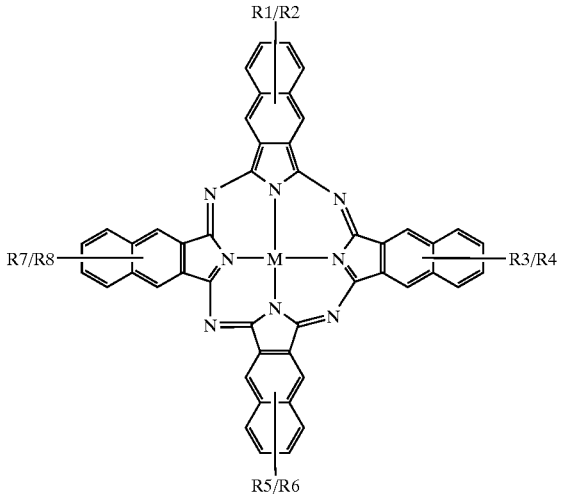

wherein:

each of R1 through R8 denotes a substituent added to a benzene ring or a naphthalene ring, and comprises a hydrogen, a halogen atom, a saturated or unsaturated hydrocarbon group having the number of carbons in a range between 1 and 18, or an oxygen and/or nitrogen content hydrocarbon group having the number of carbons in a range between 1 and 13; and M denotes two hydrogen atoms, a divalent metal, or a trivalent or tetravalent metal derivative, wherein the method comprises the steps of:

a) dispersing primarily the infrared light absorbent in a non-crosslinked polyester resin acting as a dispersion medium containing diol of not less than 80 mol % of constitutive alcohol; and b) melting, kneading and grinding the non-crosslinked polyester resin and infrared light absorbent having undergone the step a) with a toner raw material necessarily containing the binder resin, different from the non-crosslinked polyester resin, and the colorant, wherein the diol is expressed by the following chemical formula (3):

$$HO—[CR_2]_n—OH$$ Chemical Formula (3)

where:

R denotes a hydrogen, a methyl group, or an ethyl group; and n denotes a number in a range between 2 and 4, where R is not hydrogen when n=1.

9. The method as claimed in claim 8, wherein:

the binder resin comprises a polyester resin, different from the non-crosslinked polyester resin, necessarily including a not-less-than trivalent acid, and/or a not-less-than trivalent alcohol, and containing at least 1 wt % of insoluble matter foro tetrahydroxyfuran.

10. The method as claimed in claim 8, wherein:

the weight concentration of the infrared light absorbent dispersed in the non-crosslinked polyester is less than thrice the weight concentration of the infrared light absorbent in the toner; and a setting is made such that the weight ratio between the non-crosslinked polyester and the binder resin in the toner falls within a range between 35:65 and 70:30.

11. A method of manufacturing a toner for optical fixing, the toner comprising:

a binder resin;

a colorant; and an infrared light absorbent having a structure expressed by the following chemical formula (1) and/or (2):

Chemical Formula (1)

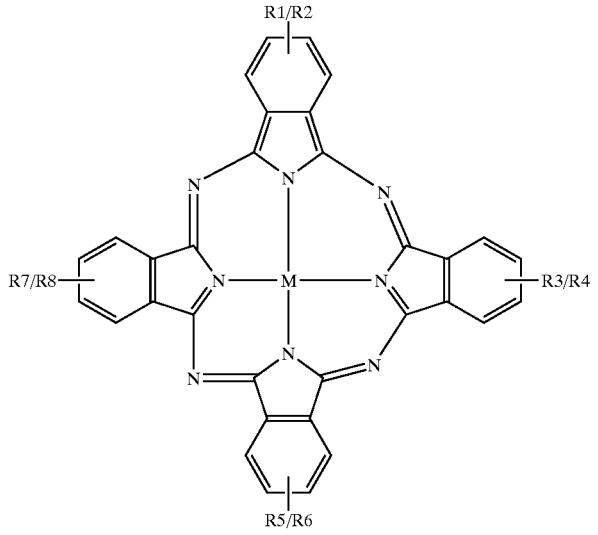

Chemical Formula (2)

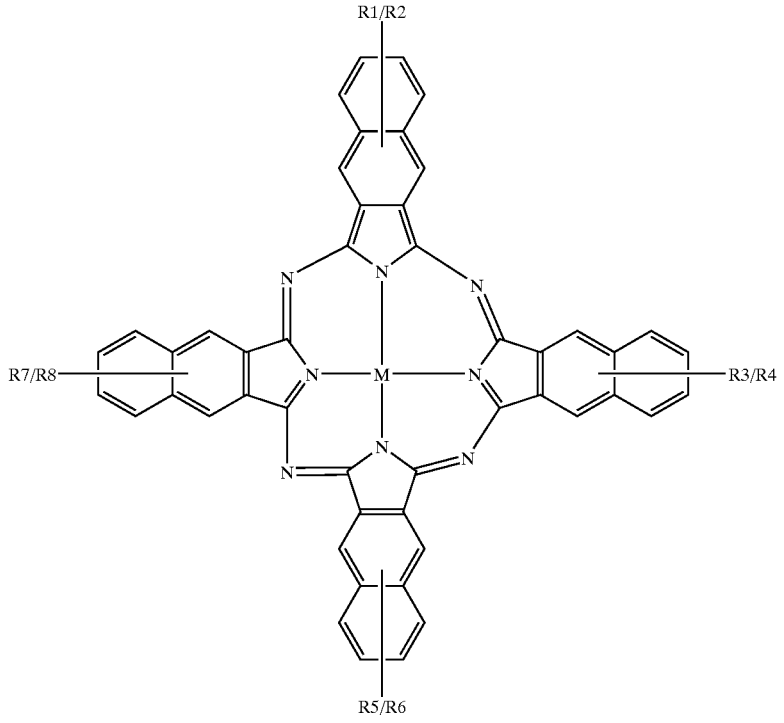

wherein:

each of R1 through R8 denotes a substituent added to a benzene ring or a naphthalene ring, and comprises a hydrogen, a halogen atom, a saturated or unsaturated hydrocarbon group having the number of carbons in a range between 1 and 18, or an oxygen and/or nitrogen content hydrocarbon group having the number of carbons in a range between 1 and 13; and M denotes two hydrogen atoms, a divalent metal, or a trivalent or tetravalent metal derivative, wherein the method comprises the steps of:

a) dispersing primarily the infrared light absorbent in a wax acting as a dispersion medium which is non-compatible with the binder resin used in the following step b); and b) melting, kneading and grinding the wax and infrared light absorbent having undergone the step a) with the wax and a toner raw material necessarily containing the binder resin, and the colorant.

12. The method as claimed in claim 11, wherein:

the binder resin comprises a polyester resin, different from the wax, necessarily including a not-less-than trivalent acid, and/or a not-less-than trivalent alcohol, and containing at least 1 wt % of insoluble matter for tetrahydroxyfuran.

13. The method as claimed in claim 11, wherein:

the weight concentration of the infrared light absorbent dispersed in the wax is less than thrice the weight concentration of the infrared light absorbent in the toner; and a setting is made such that the weight ratio between the wax and the binder resin in the toner falls within a range between 35:65 and 70:30.

* * * * *